US012623112B2

(12) United States Patent
Freiherr Taets von Amerongen

(10) Patent No.: US 12,623,112 B2
(45) Date of Patent: May 12, 2026

(54) GYMNASTIC RING AND TRAINING SYSTEM

(71) Applicant: Trainom GmbH, Berlin (DE)

(72) Inventor: Benedikt Freiherr Taets von Amerongen, Dresden (DE)

( * ) Notice: Subject to any disclaimer, the term of this patent is extended or adjusted under 35 U.S.C. 154(b) by 0 days.

(21) Appl. No.: 18/694,500

(22) PCT Filed: Jul. 12, 2023

(86) PCT No.: PCT/DE2023/150020

§ 371 (c)(1),
(2) Date: Mar. 22, 2024

(87) PCT Pub. No.: WO2024/012635

PCT Pub. Date: Jan. 18, 2024

(65) Prior Publication Data

US 2025/0135267 A1 May 1, 2025

(30) Foreign Application Priority Data

Jul. 13, 2022 (DE) ..... 202022103942.9

(51) Int. Cl.
*A63B 21/00* (2006.01)
*A63B 7/02* (2006.01)
*A63B 23/12* (2006.01)

(52) U.S. Cl.
CPC ..... *A63B 21/4035* (2015.10); *A63B 7/02* (2013.01); *A63B 23/1236* (2013.01)

(58) Field of Classification Search
CPC ... A63B 21/4035; A63B 7/02; A63B 23/1236; A63B 21/068; A63B 23/1209
See application file for complete search history.

(56) References Cited

U.S. PATENT DOCUMENTS

| | | | | | |
|---|---|---|---|---|---|
| 302,195 | A | | 7/1884 | Duryea | |
| 809,615 | A | | 1/1906 | Katherine et al. | |
| 1,013,686 | A | * | 1/1912 | Reach | A63B 7/02 482/24 |
| 1,585,334 | A | * | 5/1926 | Ensor | A63B 7/02 482/24 |
| 2,991,077 | A | * | 7/1961 | Buczak | A63B 7/02 59/93 |
| 3,115,338 | A | | 12/1963 | Acs | |
| 3,384,332 | A | * | 5/1968 | Fenner | A63B 7/00 248/165 |

(Continued)

FOREIGN PATENT DOCUMENTS

| | | | | | |
|---|---|---|---|---|---|
| DE | 9002784 | U1 | | 6/1990 | |
| DE | 10151616 | A1 | | 10/2001 | |
| DE | 202010003994 | U1 | * | 7/2010 | A63B 5/12 |

*Primary Examiner* — Andrew S Lo
(74) *Attorney, Agent, or Firm* — Schlee IP International, PC; Alexander R. Schlee; Pascal A. Schlee

(57) ABSTRACT

A gymnastic ring and a training system which can be used in a variety of body weight exercises for fitness and strength training in addition to ring gymnastics. The gymnastic ring includes a torus shaped ring body and a belt holder for mounting a belt. The belt holder can be fitted within the ring body in a form-fitting manner. As a widely applicable training device, the gymnastic ring is suitable for carrying out pushing and pulling exercises as well as many other exercises.

12 Claims, 18 Drawing Sheets

(56) References Cited

U.S. PATENT DOCUMENTS

| | | | | |
|---|---|---|---|---|
| 3,850,428 | A * | 11/1974 | Zuber | A63B 9/00 482/36 |
| 5,403,253 | A * | 4/1995 | Gaylord | A63B 69/0064 482/142 |
| D809,615 | S | 2/2018 | Ross | |
| 2005/0176557 | A1* | 8/2005 | Bork | A63B 17/04 482/37 |
| 2010/0279833 | A1 | 11/2010 | Gant | |
| 2017/0296856 | A1* | 10/2017 | Burke | A63B 71/14 |
| 2019/0076688 | A1* | 3/2019 | Turner | A63B 7/02 |
| 2019/0143168 | A1 | 5/2019 | Chang | |
| 2022/0134160 | A1* | 5/2022 | Li | A63B 7/02 482/24 |

* cited by examiner (c)

(b)

(a)

GYMNASTIC RING AND TRAINING SYSTEM

CROSS REFERENCE TO RELATED APPLICATIONS

This application is the U.S. national stage of International Application No. PCT/DE2023/150020, filed on 2023 Jul. 12. The international application claims the priority of DE 202022103942.9 filed on 2022 Jul. 13; all applications are incorporated by reference herein in their entirety.

BACKGROUND

The invention relates to a gymnastics ring with the basic shape of a rotation torus, which, in addition to being used for ring gymnastics, can be used for a variety of bodyweight exercises for fitness and strength training. As a versatile training device, the gymnastics ring is suitable for performing pressure, pulling and many other exercises. The invention also relates to a training system comprising the gymnastics ring.

A form of fitness and strength training that includes physical exercises and strength exercises performed using only your own body weight is known as calisthenics or calisthenia. Since a large number of muscle groups are regularly used during bodyweight training, calisthenics not only strengthens the individual muscles, but also the interaction between the muscles, the so-called intermuscular coordination. Muscular imbalances therefore occur less frequently than with conventional strength training. In addition to strength and endurance, calisthenics also trains mobility, sense of balance, body tension, body control and coordination as well as the deep muscles through balance exercises. With such exercises, healing processes can be significantly promoted as part of rehabilitation, for example after an operation.

The bodyweight exercises used for calisthenics include, among other things, elements from gymnastics. Weights and fitness equipment are largely avoided in this form of fitness and strength training. If at all, only simple aids are used, such as the bars, handles and rings used in gymnastics.

The sports equipment used in calisthenics includes the gymnastics rings known from ring gymnastics. These gymnastics rings-according to mathematical definition-always have the basic shape of a rotation torus created by rotating a base circle around an axis of rotation, whereby the base circle, i.e. the ring cross section, usually has a diameter in the range of 2 cm to 4 cm and a ring diameter in the range of 15 cm to 40 cm.

The essential feature of the gymnastics rings is the circular ring cross-section, i.e. the design as a simple rotation torus, which ensures that the athlete is not hindered by edges of the cross-sectional profile when gripping the gymnastics ring. This means that cross-sectional profiles other than circular shapes are not very suitable for ring gymnastics.

The conventional gymnastics rings for ring gymnastics are usually made monolithically from wood. In addition, gymnastics rings made of composite materials are also known, for example from DE 90 02 784 U1.

The sports equipment used in calisthenics also includes push-up handles, which can be used not only for performing push-ups, but also for other floor exercises, such as headstands, handstands and similar holding exercises. Such push-up handles are known, among others, from U.S. Pat. No. 3,115,338 A, DE 101 51 616 A1, US 2010/0279833 A1, US 809 615 S, US 302 195 S and US 2019/0 143 168 A1. They regularly have a handle that is attached to a support element to be placed on the floor.

An important aspect for athletes who practice calisthenics is that they want to carry out their bodyweight exercises as far as possible from any location. Sports equipment used in calisthenics should therefore be light, handy and easy to carry.

SUMMARY

The invention relates to a gymnastic ring and a training system which can be used in a variety of body weight exercises for fitness and strength training in addition to ring gymnastics. The gymnastic ring comprises a torus shaped ring body (1) and a belt holder (6) for mounting a belt (5), wherein the belt holder (6) can be fitted within the ring body (1) in a form-fitting manner. As a widely applicable training device, the gymnastic ring is suitable for carrying out pushing and pulling exercises as well as many other exercises.

DETAILED DESCRIPTION

It is therefore the object of the invention to provide sports equipment based on a gymnastics ring, which is as versatile as possible and can be used for various bodyweight exercises without additional aids or assistants.

The proposed gymnastics ring comprises a ring body which has the well-known basic shape of a rotation torus generated by rotating a base circle around a rotation axis. In the sense of the mathematical definition of terms usual for rotation torus, the ring body has an equatorial plane that is perpendicular to the axis of rotation of the ring body (or the rotation torus) and runs through the center of the base circle of the ring body (or the rotation torus). In the axial section, the ring body has the circular cross-sectional profile that is usual and necessary for gymnastics rings.

According to the invention, the gymnastics ring comprises a belt holder for holding a belt, for example on a belt sling. To fasten the belt, the ring body has at least one belt holder pocket formed within the ring body and aligned in the equatorial plane. The belt can be fixed in or on the ring body by means of the form-fitting insertable belt holder. The form-fitting connection is achieved by means of the belt holder pocket, which is geometrically suitable for the belt holder and is formed between the two ring body half-shells.

In the present context, a belt is any elongated, tensile, slack, flexible elastic element designed or suitable for carrying, securing or handling loads. These include, among other things, conventional webbing and ropes, but also chains, cables or other comparable load-bearing elements that can fulfill a similar purpose.

It can be provided that the ring body is divided into two separate ring body half-shells at the equatorial plane. It can preferably be separated into the two ring body half-shells at the equatorial plane, which acts as a dividing plane, for dismantling purposes. During assembly, the two ring body half-shells are either permanently connected to one another or releasably fixed to one another, for example by plug, dowel or screw connections. With dismountable design, the ring body can be dismantled again if necessary.

The gymnastics ring is particularly suitable for training with belted gymnastics rings, i.e. for hanging exercises similar to classic ring gymnastics. In contrast to the conventional belt attachment as a loop around the circular cross-sectional profile of the ring body, skin injuries that often occur during ring gymnastics, namely abrasions on the forearm are almost unavoidable with conventional belt routing, can be effectively suppressed by using the internal belt holder, i.e. for example with the belt end fastened between the ring body half-shells.

The gymnastics ring with a split ring body offers another advantage: the ability to easily integrate additional components into the ring body. These can include inserts for improved grip, electronic components for data acquisition, data evaluation and data communication as well as other add-on parts for expanding, changing and adapting the geometric outer surface.

The belt holder can, for example, be a rod-shaped element around which the belt is placed. The belt holder pocket in this case is a belt holder groove that geometrically matches the belt holder. The belt holder groove can, for example, also be formed on the inner radius of the ring body, so that the belt holder can be inserted into the belt holder groove and also removed without separating the two ring body half-shells. This means that the belt can be quickly attached to the ring body and removed again. When used, the belt holder is securely locked in the belt holder groove by the tensile loaded belt.

The belt holder can also be designed as a quick-release fastener in the form of a two-part locking system. A part of the belt holder, called the belt lock, is permanently installed in the belt holder pocket, while the other part of the belt holder, called the lock tongue, is attached to the belt. To fasten the belt, a portion of the lock tongue is preferably designed as a belt buckle, as a clamp buckle or as a clamp lock, through which the belt is guided in the form of a belt sling or belt loop. The lock tongue is designed in such a way that it snaps into the belt lock located in the belt holder pocket by inserting it, so that the locking end region of the lock tongue attached to the belt lies within the ring body, i.e. between the two ring body half-shells, after snapping in. In addition to creating a mechanical connection when the lock tongue snaps into the belt lock, electrical contacts can be integrated into the belt holder designed as quick-release fastener, which are closed when locked and can be used for data and power transmission.

To carry out exercises, the athlete regularly needs a set, i.e. a pair, of gymnastics rings. These two gymnastics rings are preferably designed to be mirror images of each other.

In terms of the size of the ring body, the gymnastics ring according to the invention preferably corresponds to the size of commercially available gymnastics rings. It can therefore easily be carried in standard sports bags.

A suitable material for the ring body is, for example, wood, especially birch wood or beech wood. Various plastics, fiber composite materials or metals, such as aluminum materials, can also be used.

The ring body can also have an internal hollow structure with stiffening elements, wherein the stiffening elements preferably forming a truss or framework within the ring body with cavities between the stiffening elements. Ring bodies designed in this way are characterized by a low weight and at the same time great mechanical stability and rigidity.

According to a preferred embodiment of the gymnastics ring, a bow handle is attached to the ring body in a cantilevered manner and at a distance from the equatorial plane of the ring body. The bow handle has a handle center piece located between two bow handle ends. It is also designed to be mirror-symmetrical with respect to a handle center plane that longitudinally intersects the bow handle.

According to this embodiment of the invention, the bow handle and the ring body are aligned or arranged with respect to one another in such a way that the handle center plane of the bow handle lies in an axial sectional plane of the ring body which runs through the axis of rotation of the ring body. This axial section plane of the ring body intersects the ring body at two radially opposite sectioning positions, in the area of which a fastening location is formed on the ring body for attaching one of the bow handle ends. The two bow handle ends are attached to the ring body in such a way that both bow handle ends point towards the same side of the equatorial plane of the ring body. This means that the bow handle is aligned transversely to the ring body and protrudes vertically from it. The respective end of the bow handle is positioned at its fastening location away from the surface of the ring body.

The belt holder pocket is preferably arranged centrally between the two fastening locations on the ring body. The bow handle, which is vertically aligned due to the longitudinal extension of the belt, can be used as an alternative handle element (instead of the ring body) when performing hanging exercises.

The distance of the handle center piece from the axial sectional plane is preferably larger than the diameter of the base circle forming the rotation torus, that is, larger than the ring body cross section.

The bow handle can be attached to the ring body in a detachable manner, for example by means of a plug-in and/or a screw connection, or in a non-detachable manner, for example by means of an adhesive connection. Preferably, the bow handle ends are designed to match the shape of the ring body, that is, the respective bow handle end and the ring body are geometrically coordinated with one another in the area of the fastening location. For this purpose, the ring body can also be slightly flattened in this fastening location area, that is, it can deviate from the circular cross-sectional profile of the ring body.

The gymnastics ring according to the embodiment with a bow handle is characterized in that, in addition to being used for ring gymnastics, it can be used for a number of body-weight exercises, for example for holding exercises, similar to those that are commonly carried out on parallel bars. It can also be used as a push-up handle. The support formed by the ring body directs the weight forces on a circular contact line and thus largely evenly into the support surface (for example the floor) and thus ensures the safe and stable position required for the bodyweight exercises; The risk of tipping over or twisting an ankle during training is therefore greatly reduced. The bow handle also offers additional grip options that allow balancing on the floor. In addition, wrist-supporting hanging exercises can be carried out for the first time.

In addition, the gymnastics ring according to the invention itself, i.e. similar to a dumbbell, can be used for weight exercises, and additional weights can also be added to make the exercise more demanding. The water resistance exercises typical for rehabilitation purposes can also be carried out with the gymnastics ring.

The cross-section of the handle center piece is preferably dimensioned similarly to the ring body cross section, that is, the ring body and the handle center piece have the same or similar cross-sectional dimensions.

According to one embodiment of the gymnastics ring, the handle center piece of the bow handle is straight in its longitudinal extent. The straight handle center piece is preferably aligned at an angle of 83°±2° to the axis of rotation of the ring body, that is, the handle center piece is inclined by 7°±2° with respect to the equatorial plane. This enables training to be particularly gentle on the wrists.

According to another embodiment of the gymnastics ring, the handle center piece has a straight section in its longitudinal extent, which is aligned parallel to the equatorial plane. One of the handle ends is located at one of the end regions of the straight section, which extends approximately half the length of the handle center piece. Between the other end of the handle and the other end region of the straight section there is a transition section that is angled towards the straight section. The transition piece can also be ergonomically shaped.

It can be provided that at least the handle center piece of the bow handle has an oval or elliptical cross-sectional profile. Preferably, with an oval, i.e. egg-shaped, cross-sectional profile of the handle center piece, the side of the bow handle facing the ring body is more strongly curved and the side of the bow handle facing away from the ring body is less curved, that is, slightly flattened. The handle center piece with an oval or elliptical cross-sectional profile enables particularly ergonomic gripping of the bow handle. Other screw attachments can also be used for handle variations (for example a higher bow handle).

According to one embodiment of the gymnastics ring with a bow handle, the bow handle is divided into two parts along the bow line, with each part of the bow handle forming an integral component with one of the ring body half-shells. The ring body half-shells and the parts of the bow handle preferably have an inner hollow structure with stiffening elements, which, for example, form a truss or framework.

The same materials that are preferred for the ring bodies are suitable as the material for the bow handle. Preferably, the ring body and bow handle are made of the same material.

It can also be provided that the bow handle is releasably attached to the ring body with connecting elements hidden between the two ring body half-shells. For example, the bow handle can be screwed with screw connections from the inner surface of one of the ring body half-shells. The screw connections remain invisible to the outside and do not hinder training. In addition to screw connections, other separable connections, such as magnetic connections or locking hook connections, can also be used to connect the ring body half-shells. A permanent, non-separable connection, for example by gluing, soldering or welding, as well as a casting from a form-fitting upper body is also possible.

Alternatively, connecting elements can also be arranged specifically as a style element on the visible surface of the ring body, for example to enable easier opening of the ring body after production.

According to one embodiment of the invention, the gymnastics ring and the belt are components of a training system with a hanging ring body. The training system also has a belt adjustment unit connected to the belt holder, which in turn includes a clamp lock and a release belt. The training system is used as intended so that the ring body of the gymnastics ring hangs from the belt. The belt, which is fixed in the clamp lock at one end, the belt fixed end, is guided around a suspension (rod, hook, branch, etc.) located above the exercise position and the other end, the belt free end, is guided through the clamp lock. The double part of the belt between the suspension and the clamp lock forms the load-bearing part of the belt in the form of a belt sling or belt loop. The belt free end of the belt is guided through the clamp lock in such a way that when the load is applied via the belt holder—by means of a spring-loaded lock—the clamp lock automatically clamps the belt through friction or force fitting and fixes the belt length of the load-bearing belt sling through self-locking. This means that the belt is prevented from slipping through by the clamp lock. The belt free end of the belt is also guided in the clamp lock in such a way that a pull on the unloaded belt free end of the belt overcomes the clamping force and allows the belt to be pulled through the clamp lock towards the belt free end of the belt. This means that when the belt free end is pulled, the belt can be pulled through without the locking being unlocked, since the locking is designed in such a way that the frictional engagement in the clamp lock is overcome with little effort when the belt is pulled in the direction of the belt free end. The belt length of the load-bearing belt sling is thus shortened by pulling on the unloaded belt free end of the belt, which means that the belt adjustment unit hanging on the load-bearing part of the belt and with it the ring body attached via the belt holder can be pulled upwards in a stepless variable manner. The release belt of the belt adjustment unit is attached to the clamp lock in such a way that when the release belt is pulled, the self-locking of the belt is released by unlocking the lock, which in turn moves the clamp lock continuously along the belt respectively the belt free end is pulled through the clamp lock towards the belt sling side. This increases the belt length of the load-bearing belt sling, which means that the belt adjustment unit hanging on the load-bearing part of the belt and with it the ring body attached via the belt holder can be pulled downwards in a stepless variable manner. The belt adjustment unit makes it possible to continuously adjust the height of the ring body to a height desired for the sport to be practiced by either pulling on the unloaded belt free end of the belt or on the release belt. In particular, by changing the length of the belt sling, the ring body or the ring bodies can be brought to a height that is higher than the length of the athlete with his arm stretched upwards, that is, the athlete can practice hanging with his arms stretched out without touching the ground. The load-bearing length of the belt can be adjusted solely by the athlete without any aids. The proposed belt adjustment unit can also be used advantageously for fine adjustment of the gymnastics rings, which usually hang next to each other in pairs, to the same height.

The belt adjustment unit can be motorized, that is, it is equipped, for example, with an electric motor for belt adjustment. The control can be implemented via a remote control (for example using a smartphone) or via a control unit integrated into the ring body. Furthermore, a pressure sensor can also be integrated into the belt adjustment unit.

Preferably, the belt adjustment unit is attached to the belt holder designed as a quick-release fastener, with the belt adjustment unit being integrated into the part of the belt holder known as the lock tongue. This version of the training system is suitable for quickly switching between hanging and floor exercises.

The training system may further include a retractor mechanism for rewinding the belt.

In addition, the training system can be provided with a skin-protecting device that largely prevents skin contact with metal parts during training.

The belt adjustment unit of the training system preferably has an internal belt guide, which ensures optimal sliding of the belt and locking it in the desired position. For this purpose, the belt can, for example, have a stiffener at the end piece. Herewith, the belt slides largely in a straight line through the belt adjustment unit. It also prevents the belt tip from rolling back or pointing in the wrong direction.

In the gymnastics ring, a number of components, in particular electronic components, can be integrated if they can be divided into the ring body half-shells. For example, a number of different sensors, actuators and processors can be installed in the ring body and/or in the bow handle.

Acceleration sensors, rotation rate sensors and magnetometers, also combined within an inertial measurement unit (IMU for short), are used to detect movement, to determine the position in space, to determine the belt length and/or to determine the relative position of the gymnastics rings of a pair of rings. Capacitive sensors can be used for presence or user detection. They are also suitable for establishing a connection or detecting gymnastics rings used as a pair, also known as "pairing". Pressure or force sensors, for example strain gauges or piezo force transducers, can be used, among other things, to determine the athlete's weight, the mechanical load and, if the time course is also recorded, to determine the number of exercises. Heart rate sensors are used to detect the athlete's exertion and other physiological parameters. Using integrated luminosity sensors, brightness control for integrated display elements can be carried out.

According to an embodiment of the gymnastics ring with a bow handle, the gymnastics ring can have a pressure sensor at at least one of the fastening locations between the ring body and the bow handle end of the bow handle that attaches to this fastening location. The pressure sensor can be used to record the loading and/or unloading of the gymnastics ring. A transmission unit connected to the pressure sensor for wireless signal transmission of the signals detected by the pressure sensor is also installed in the gymnastics ring. The transmitted signals can be sent to a display and evaluation unit, for example a smartphone, in order to visualize the signals as real-time feedback, for example during training, and if necessary, also to analyze them after training. This embodiment of the gymnastics ring makes it possible to record training data, for example the number and quality of push-ups or dips. The athlete can therefore concentrate more on the qualitative execution of the exercises and at the same time achieve the quantitative training goal without having to count.

It can also be provided that a position sensor is installed within the gymnastics ring, preferably within the ring body between the ring body half-shells. The position sensor is set up to detect the orientation of the gymnastics ring in space, that is, in relation to the effect of gravity, the earth's magnetic field and/or another absolute positioning or orientation reference. The detected signals can in turn be connected to a transmitting unit connected to the position sensor for wireless signal transmission. By evaluating and monitoring the position of the ring body, the athlete can specifically optimize their posture during training.

RFID transponders, near field communication chips (NFC) or other components for radio signal transmission can also be integrated into the gymnastics ring, for example for owner recognition, theft detection, establishing a connection or coupling with a mobile phone, with small computer systems that are worn directly on the body (wearables)—such as smartwatch, fitness tracker, data glasses—or can be used with another gymnastics ring.

The gymnastics ring can also include various feedback or feedback components, for example illuminants, indicators or displays for visual feedback, speakers for acoustic feedback or vibration motors for haptic feedback.

The illuminants can be, for example, light-emitting diodes (LEDs), LED strips or LED arrays. They are used, among other things, for aesthetic adjustment, for personalization, for identification, for issuing training instructions and training progress, as a pacemaker, for displaying the system status and much more.

Furthermore, the gymnastics ring can include processors for processing the data collected via the sensors.

It can also be provided that the gymnastics ring has inlays or inserts made of elastomer, for example rubber or silicone rubber. For example, two elastomer handle parts can be connected both separably and inseparably to the handle center piece of the bow handle. For this purpose, pockets can be embedded in the handle center piece into which the elastomer handle parts are inserted.

BRIEF DESCRIPTION OF THE DRAWINGS

The invention is explained in more detail below using exemplary embodiments and with reference to the schematic drawings, where the same or similar features are provided with the same reference numerals; show this

DETAILED DESCRIPTION OF THE PREFERRED EMBODIMENTS

Figure 1:
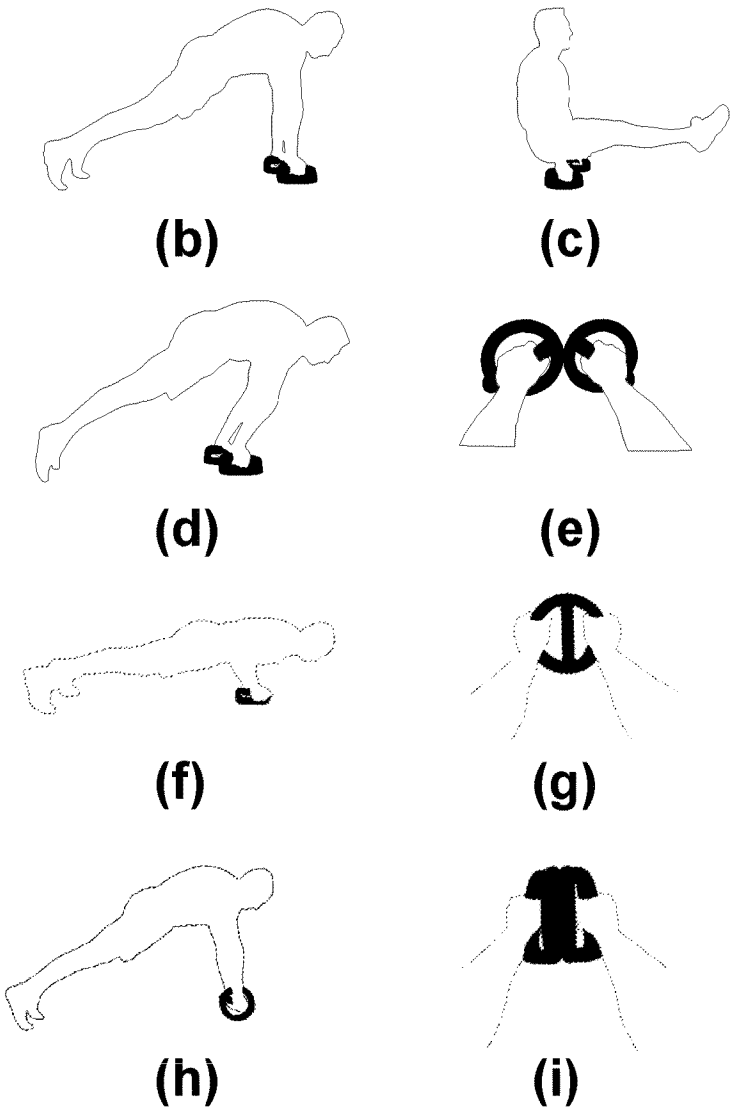
FIG. 1: a set of two gymnastics rings placed on the floor according to a first embodiment and their use in floor exercises in perspective views.
Figure 1:
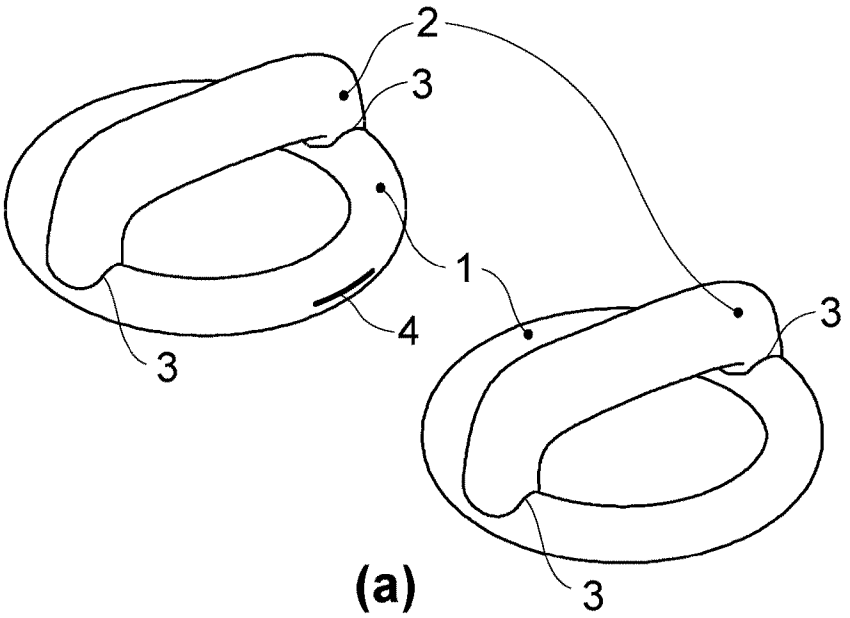

The two gymnastics rings according to the first embodiment according to FIG. 1 are placed next to each other in the arrangement typical for floor exercises, as shown in partial FIG. 1 (*a*). The athlete grasps the bow handle 2 with one hand; the ring body 1 serves as a support. The bow handle 2 is fixed at two fastening locations 3 on the ring body 1 in a shape-adapted manner. The two gymnastics rings according to FIG. 1 are designed to be mirror-symmetrical. The slot-like belt holder pocket 4 is therefore only visible on the gymnastics ring shown at the top left in FIG. 1. The partial (b) to (i) of FIG. 1 show examples of various floor exercises made possible with the gymnastics ring.

Figure 2:
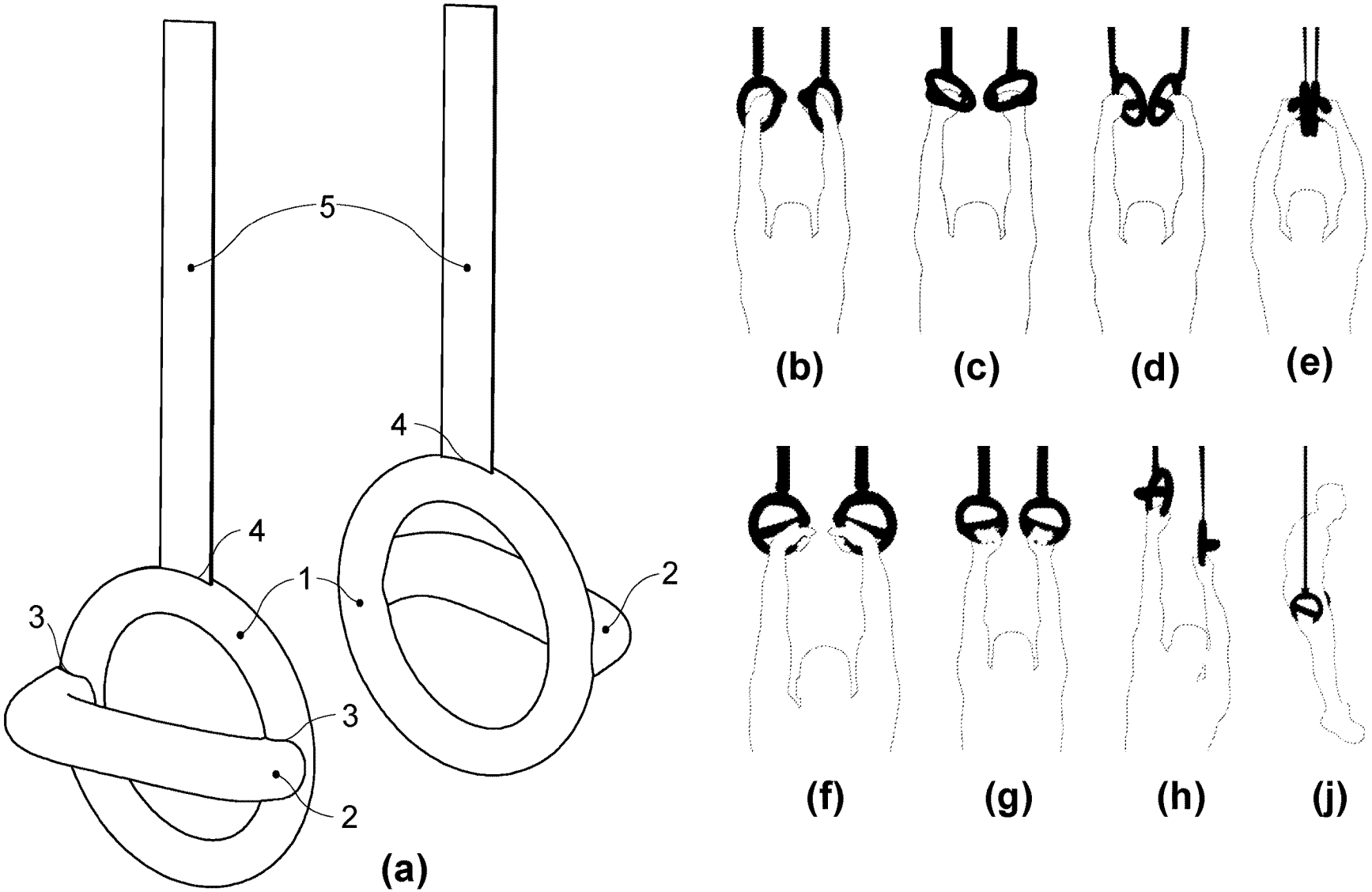
FIG. 2: a set of two belted gymnastics rings according to the first embodiment and their use in ring gymnastics in perspective views.

The gymnastics rings of the first embodiment, which are attached to the belts 5 in pairs and mirror images next to one another as shown in FIG. 2, are used to carry out bodyweight exercises that are mainly carried out in a hanging position as shown in FIG. 2 (*a*). The two bow handles 2 are turned outwards in the example in FIG. 2 (*a*). In this case, the athlete grips the ring body 1 of the gymnastics rings with his hands from the inside-analogous to the grip in classic ring gymnastics. The belts 5 run via the belt holder pocket 4 into the interior of the ring body 1. They are each attached there using a belt loop. The partial figures (b) to (i) of FIG. 2 show examples of various hanging exercises made possible with the gymnastics ring.

Figure 3:
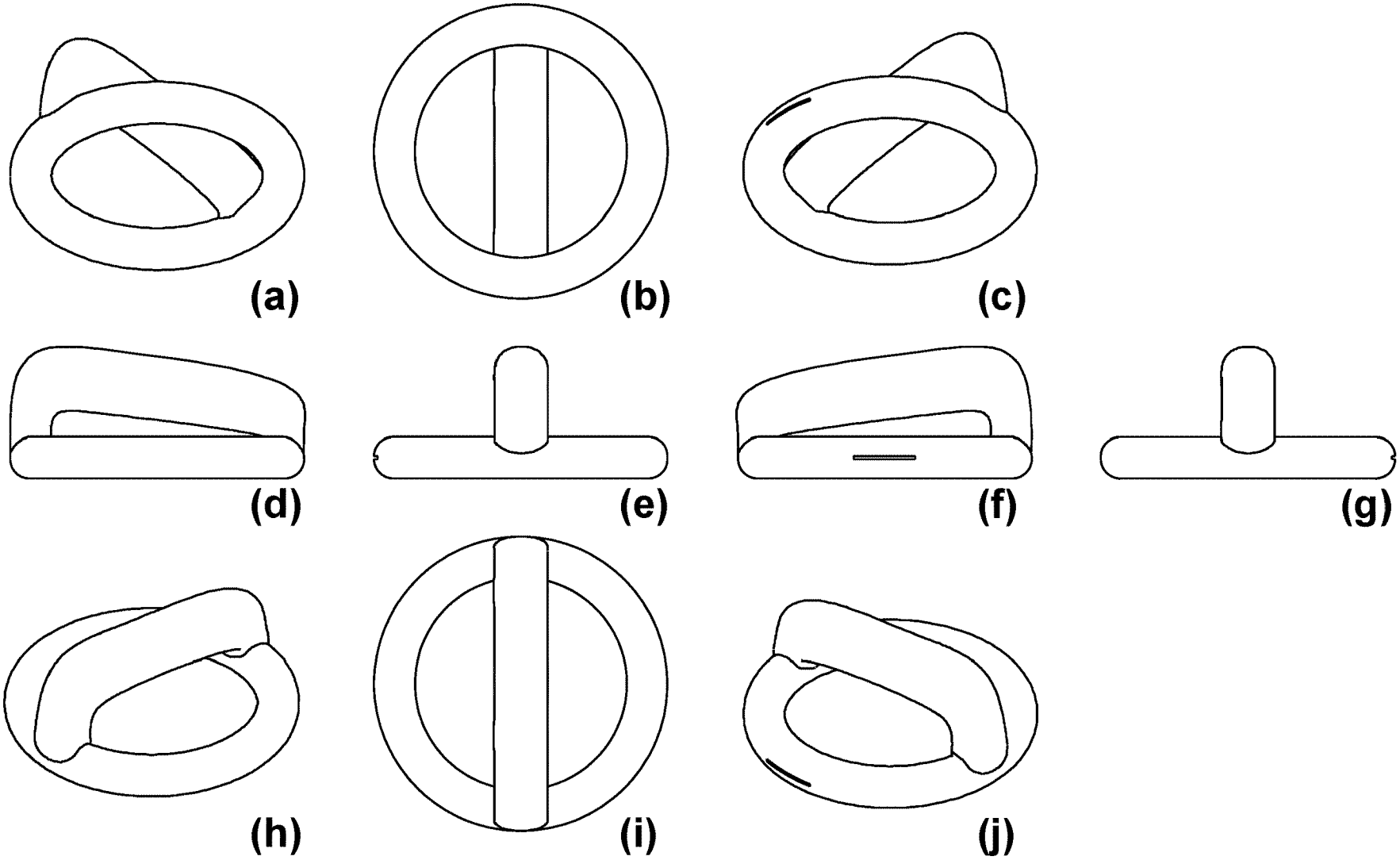
FIG. 3: the gymnastics ring according to the first embodiment in ten different views.

In FIG. 3, the gymnastics ring according to the first embodiment is shown to scale in ten different views. Here show: FIG. 3 (*e*): the view from the front, FIG. 3 (*g*): the view from the back, FIG. 3 (*d*): the view from the right, FIG. 3 (*f*): the view from the left, FIG. 3 (*b*): the view from below, FIG. 3 (*i*): the view from above and FIG. 3 (*a*), FIG. 3 (*c*), FIG. 3 (*h*) and FIG. 3 (*j*) four different perspective views. The reference numbers have been omitted in FIG. 3 for reasons of clarity.

Figure 5:
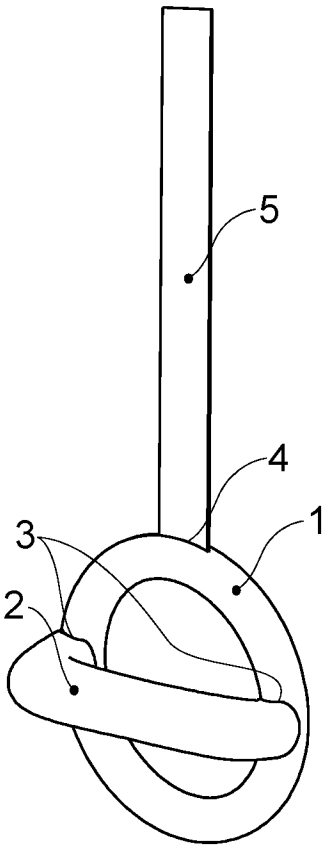
FIG. 5: the assembled gymnastics ring according to the first embodiment in a perspective view.
Figure 4:
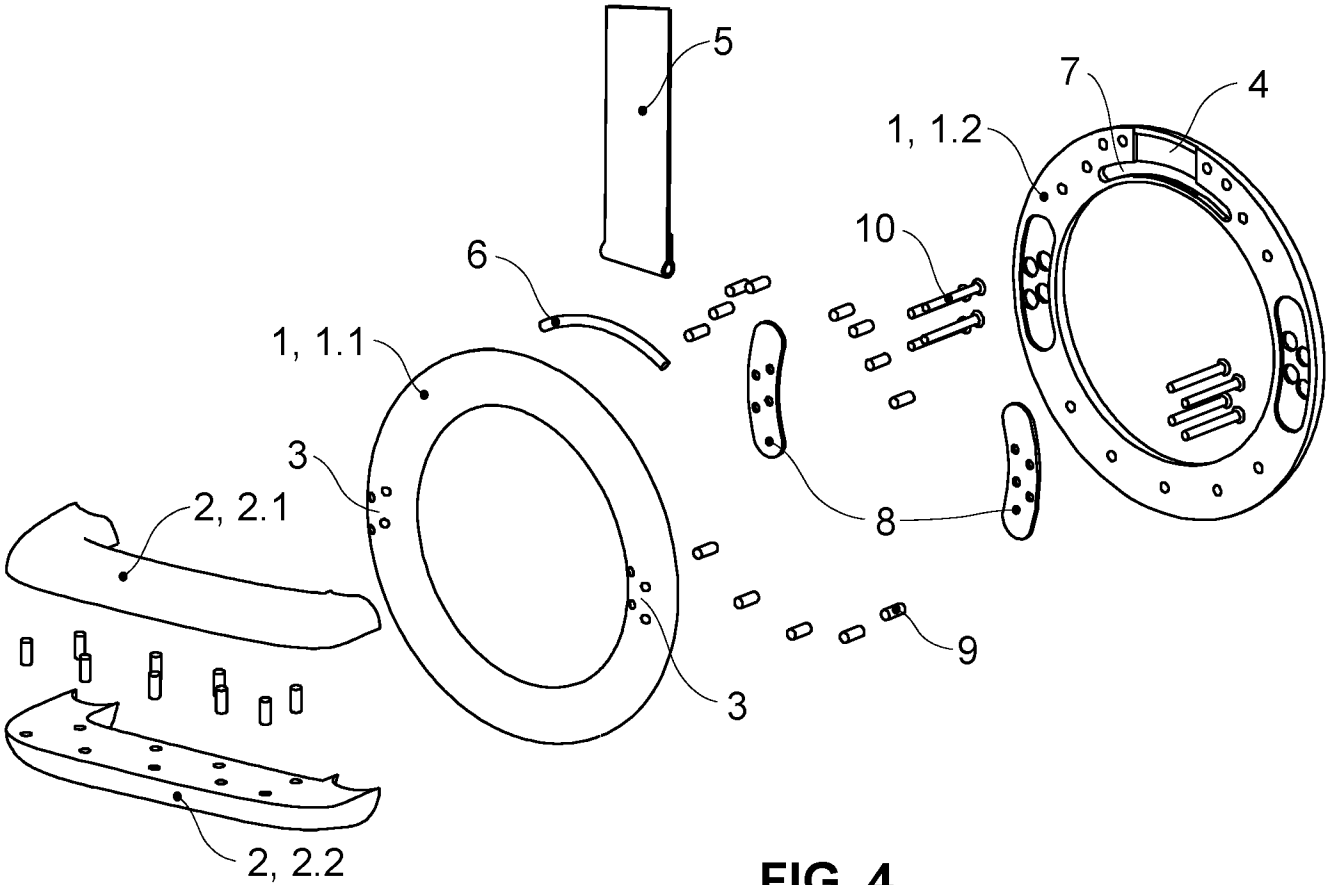
FIG. 4: the gymnastics ring according to the first embodiment, disassembled into individual components, in a perspective view.

FIG. 4 and FIG. 5 show the gymnastics ring according to the first embodiment in the disassembled and in the assembled state.

According to FIG. 4, the ring body 1 is composed of the two ring body half-shells 1.1, 1.2. The bow handle 2 also includes two matching bow handle half-shells 2.1, 2.2. The ring body half-shells 1.1, 1.2 and the bow handle half-shells 2.1, 2.2 are connected to one another via pin connections that ensure the geometric fit. The pin connections each include the pins 9 and the matching blind holes. In FIG. 4, only one of the pins 9 is designated for reasons of clarity. The pins 9 can, for example, be designed like wooden dowels.

Four through holes are made at the fastening location 3, through which the screws 10 for fastening the bow handle 2 are guided through the ring body half-shell 1.1. Similar to a washer, the reinforcement plates 8 inserted between the ring body half-shells 1.1, 1.2 serve as a support for the screw head of the screws 10.

The curved, rod-shaped belt holder 6 is guided through the belt loop formed at the end of the belt 5. The belt holder 6 is then inserted between the two ring body half-shells 1.1, 1.2, with the belt holder 6 lying in a form-fitting manner in the belt holder groove 7 and the belt 5 in the belt holder pocket 4. This creates the internal belt fastening mechanism illustrated in FIG. 5.

Figure 7:
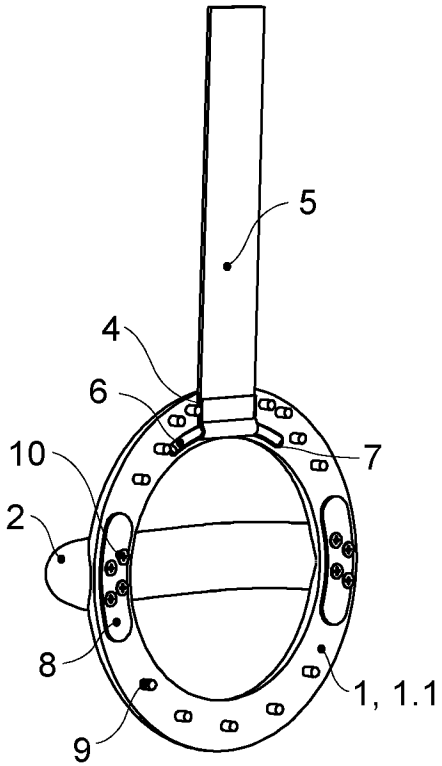
FIG. 7: the partially assembled gymnastics ring according to the first embodiment in a perspective view.
Figure 6:
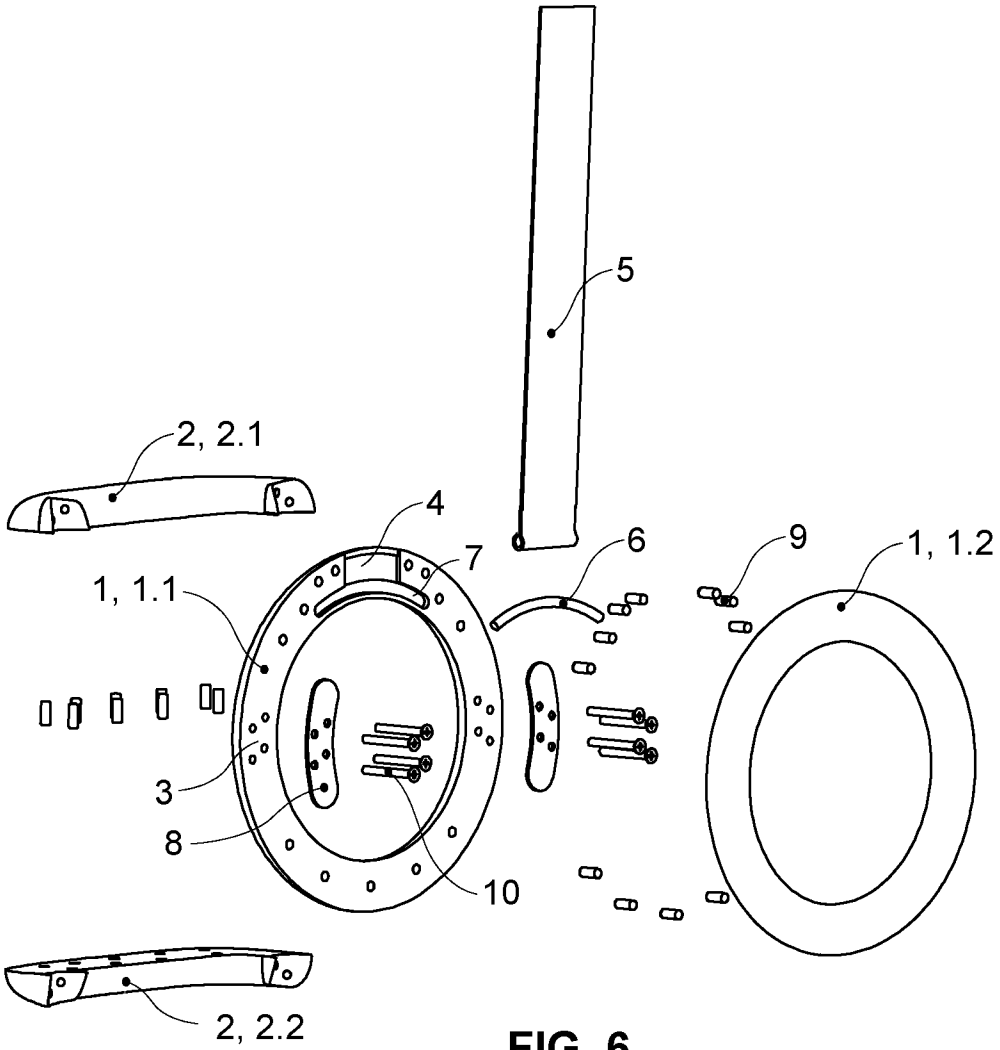
FIG. 6: the gymnastics ring according to the first embodiment, disassembled into individual components, in a perspective view.

The drawings in FIG. 6 and FIG. 7 corresponding to FIG. 4 and FIG. 5 show the gymnastics ring according to the first embodiment from a further perspective-again in the disassembled and in the partially assembled state.

FIG. 6 illustrates in particular the bow handle ends of the bow handle 2, which are geometrically adapted to the ring body 1, as well as the position of the reinforcement plates 8 in relation to the fastening locations 3.

FIG. 7 shows the belt holder 6 inserted into the belt holding groove 7 and guided through the belt loop of the belt 5. FIG. 7 also illustrates the screwing of the bow handle 2 to the inside of the ring body half-shell 1.1 with the reinforcement plates 8 positioned under the screw heads of the screws 10.

Figure 9:
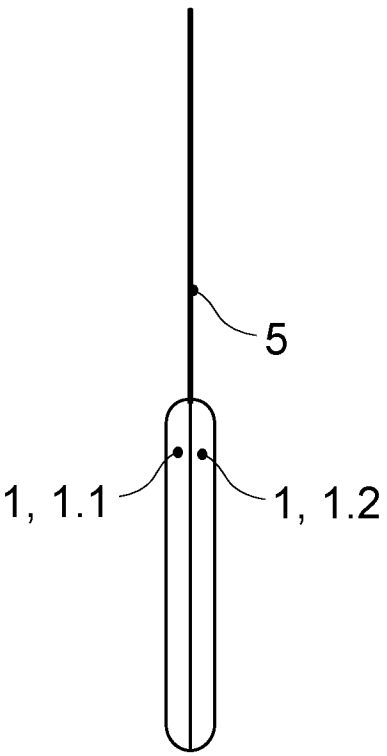
FIG. 9: the assembled gymnastics ring according to the second embodiment, without a bow handle, in side view.
Figure 8:
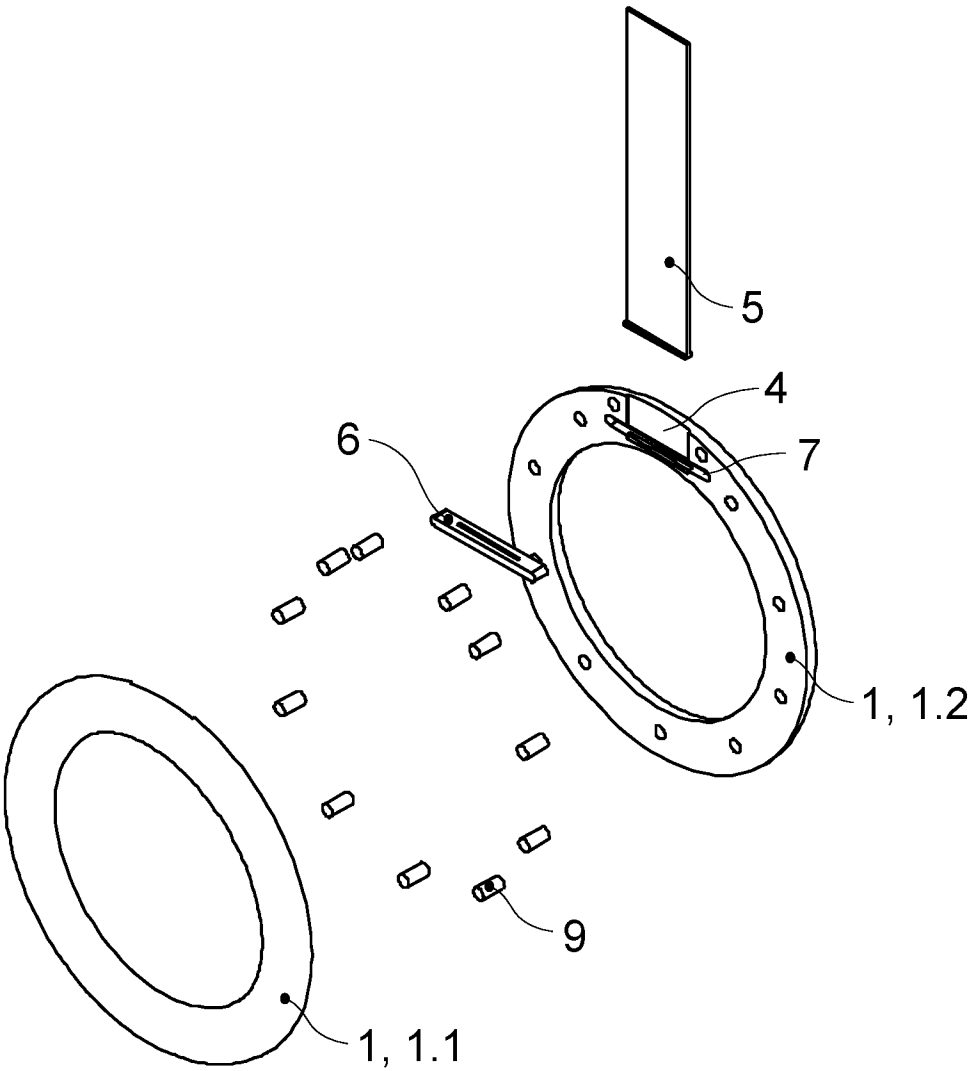
FIG. 8: the gymnastics ring according to a second embodiment, without a bow handle, disassembled into individual components, in a perspective view.

FIG. 8 and FIG. 9 show the gymnastics ring in a second embodiment without the bow handle 2 in the disassembled and in the assembled state.

The two ring body half-shells 1.1, 1.2 of the ring body 1 are connected with pin connections. One of the pins 9 used for this is designated as an example. The ring body half-shells 1.1, 1.2 can be connected separably or inseparably.

While the ring body 1 is designed largely identically, the belt holder according to FIG. 8 differs from that shown in FIGS. 4, 6 and 7 In the embodiment according to FIG. 8, the belt 5 has a T-shaped end piece, which locks the belt 5, which is guided through a slot in the cuboid belt holder 6, on the belt holder 6. The belt holder 6 is then inserted with the belt 5 inserted through it into the belt holder groove 7 and the belt 5 lying inside the belt holder pocket 4 between the two ring body half-shells 1.1, 1.2 is led out of the ring body 1.

The side view in FIG. 9 illustrates the position of the belt 5 between the two ring body half-shells 1.1, 1.2 of the ring body 1.

Further variants of the belt holder are shown in FIGS. 10 to 15.

Figure 11:
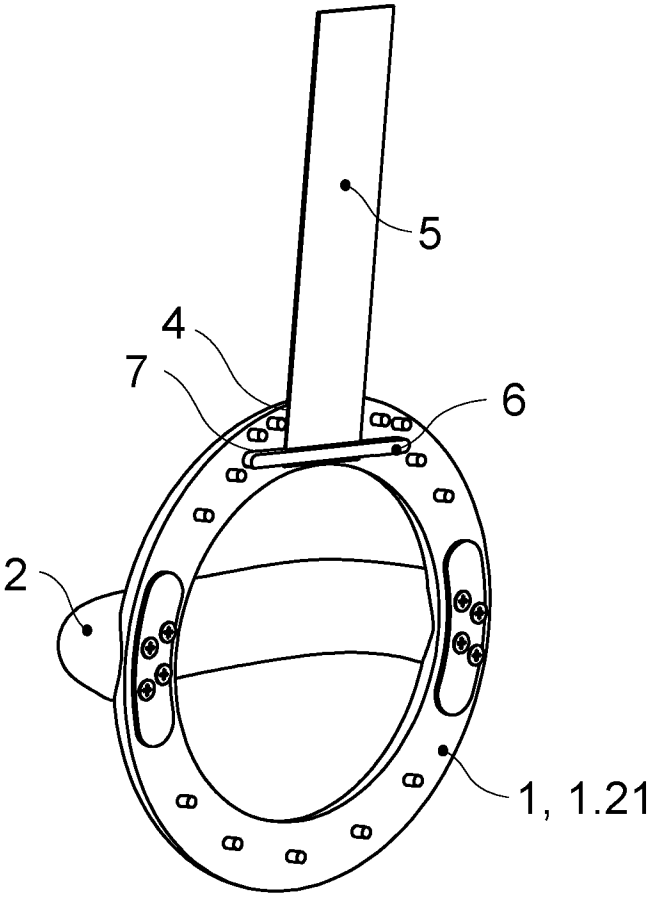
FIG. 11: the partially assembled gymnastics ring according to the third embodiment in a perspective view.
Figure 10:
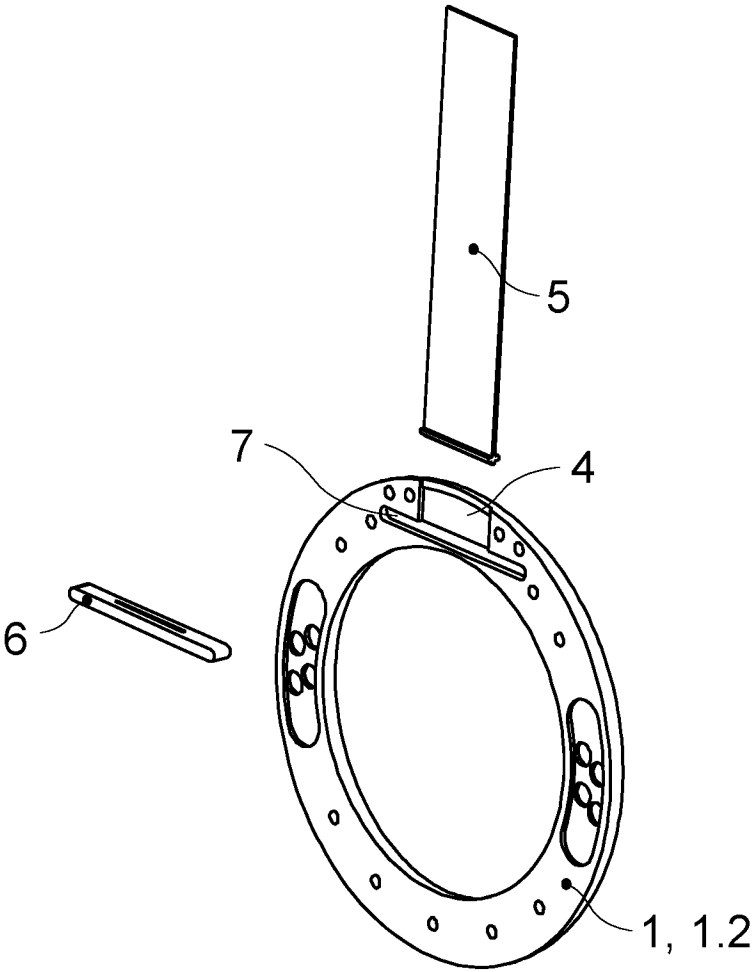
FIG. 10: the gymnastics ring according to a third embodiment, disassembled into individual components, in a perspective view.

The belt holder according to the third embodiment of the gymnastics ring shown in FIG. 10 and FIG. 11 is largely identical to that according to FIG. 8 and FIG. 9. The belt 5 here has a cross-shaped end piece.

Figure 12:
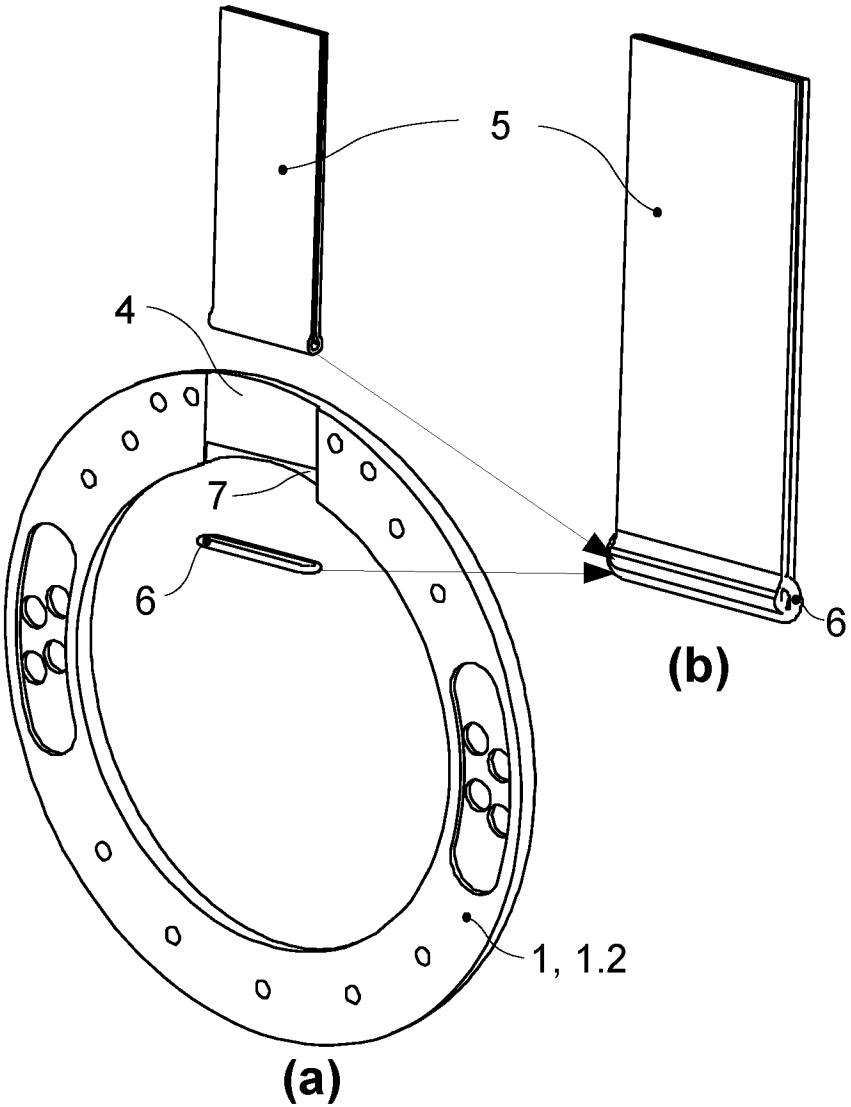
FIG. 12: the gymnastics ring according to a fourth embodiment, disassembled into individual components, in a perspective view.

According to the fourth embodiment of the gymnastics ring shown in FIG. 12, the belt holder 6 is designed in the form of an elongated ring element, similar to a chain link (see FIG. 12 (*a*)). To fasten it, the belt 5 is guided through the belt holder 6, a loop is formed and the belt holder 6 is rotated by 90° (see detailed illustration in FIG. 12 (*b*)).

When the belt 5 is guided through the belt holder pocket 4, the belt holder 6 snaps into the belt holder groove 7 in this position and thus locks the (tensile loaded) belt 5 in the ring body 1. The belt 5 can be used in the embodiment of the belt fastening mechanism shown in FIG. 12 can be released and assembled without dismantling the ring body 1.

Figure 13:
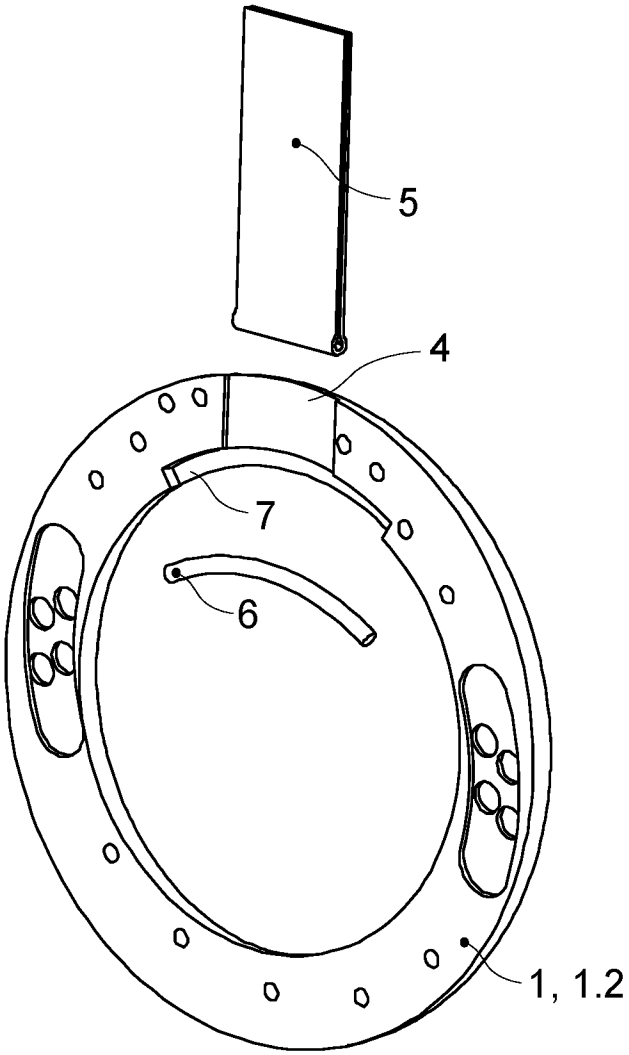
FIG. 13: the gymnastics ring according to a fifth embodiment, disassembled into individual components, in a perspective view.

A belt fastening mechanism with similar functionality is shown in the fifth embodiment of the gymnastics ring in FIG. 13. The embodiment of the belt holder 6 and the belt holder groove 7 largely correspond to those according to FIGS. 4, 6 and 7, with the difference that the belt holder groove 7 is positioned on the inner radius of the ring body 1, so that the belt holder 6 can be removed from the belt holder groove 7 without dismantling the ring body 1 when the belt 5 is not under tension, for example to remove the belt 5.

Figure 15:
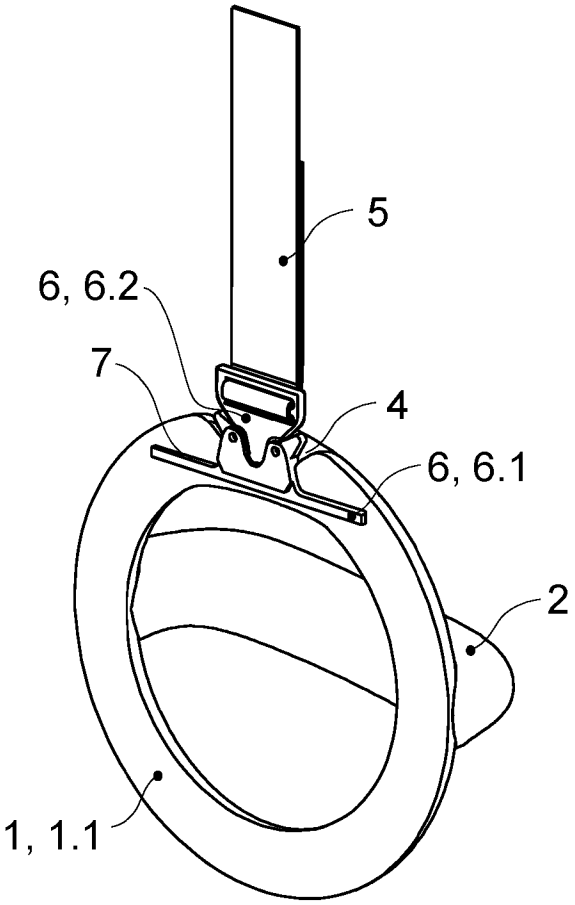
FIG. 15: the partially assembled gymnastics ring according to the sixth embodiment in a perspective view.
Figure 14:
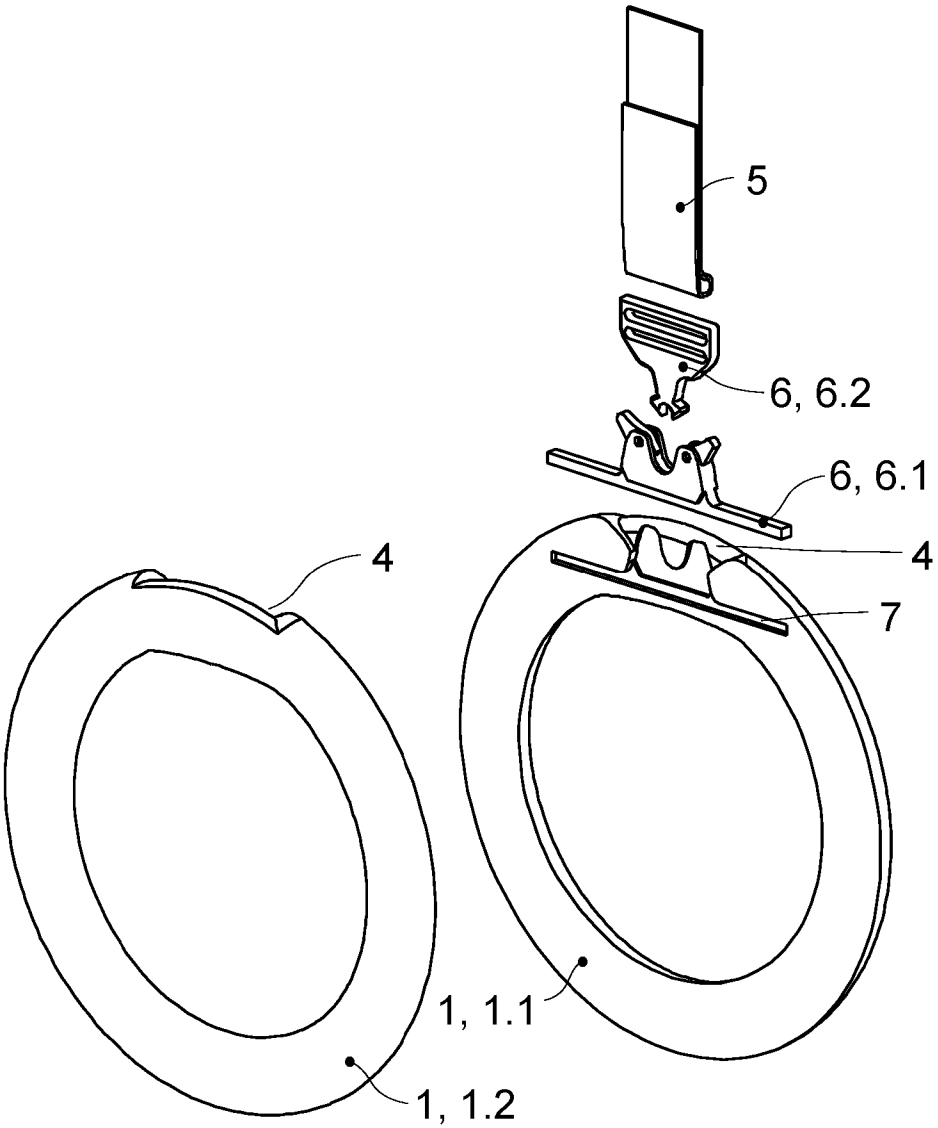
FIG. 14: the gymnastics ring according to a sixth embodiment, disassembled into individual components, in a perspective view.

The belt holder according to the sixth embodiment of the gymnastics ring shown in FIG. 14 and FIG. 15 includes the locking system or the quick-release fastener. The belt 5 is attached to a part of the belt holder 6, the lock tongue 6.2, in a belt buckle formed on the lock tongue 6.2. The other part of the belt holder 6, designated as the belt buckle 6.1, is inserted into the belt holder pocket 4. To establish the connection between the belt 5 and the ring body 1, the lock tongue 6.2 is snapped into the belt lock 6.1. The belt holder pocket 4 within the ring body 1 is adapted to the shape of the belt holder 6, more precisely the belt lock 6.1.

Figure 16:
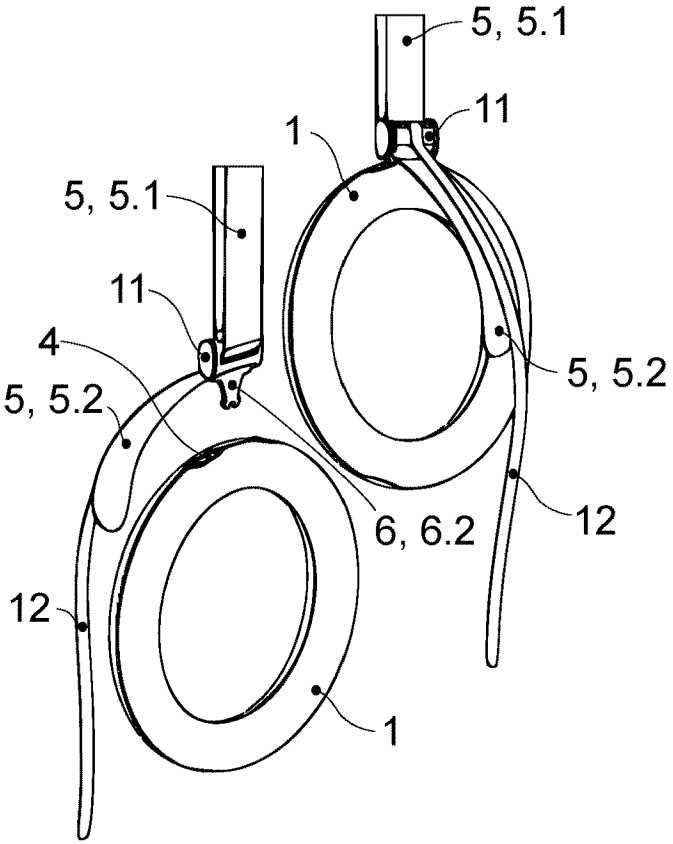
FIG. 16: the training system with hanging ring bodies in a perspective view.

The training system with hanging ring bodies 1 according to FIG. 16 comprises two gymnastics rings, wherein the belt holder 6 corresponds to the sixth version of the gymnastics ring as a quick-release fastener consisting of a belt lock 6.1 and a lock tongue 6.2. To connect the ring body 1 to the belt 5, the lock tongue 6.2 of the belt holder 6 is snapped into the belt lock 6.1 of the belt holder 6 (not shown) inserted into the belt holder pocket 4. The clamp lock 11 is formed on the lock tongue 6.2, through which the belt 5 is guided. Above the clamp lock 11 in FIG. 16 is the part of the belt 5 which forms the load-bearing belt sling 5.1. The part of the belt 5 which is led out of the clamp lock 11 and hangs downwards forms the load-free belt free end 5.2. The release belt 12 is also attached to the clamp lock 11. The clamp lock 11 and the release belt 12 together with the part of the belt 5 located inside the clamp lock 11 form the belt adjustment unit.

Figure 17:
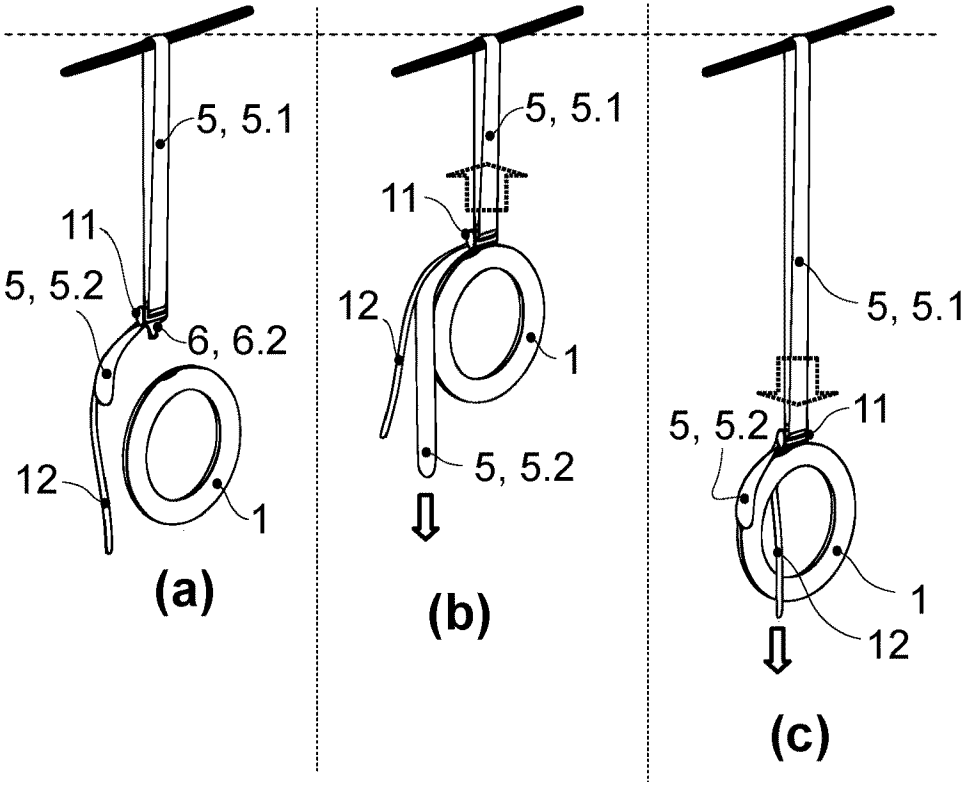
FIG. 17: the functionality of the training system with hanging ring bodies in a perspective view.

The functionality of the training system according to the embodiment of FIG. 16 is shown using a hanging ring body 1 in the partial figures (a)-(c) of FIG. 17.

In FIG. 17 (*a*), the belt 5 is attached with its part designed as a belt sling 5.1 to an unnamed, rod-shaped suspension by looping around it, so that the lock tongue 6.2 of the belt holder 6, detached from the ring body 1, hangs vertically downwards with the clamp lock 11 attached to it. The belt 5 is locked in the clamp lock 11 by self-locking by means of a spring-loaded lock, so that when the ring body 1 is attached and loaded, the belt length of the belt sling 5.1 remains unchanged, which means that the clamp lock 11 does not slip on the belt 5. The belt free end 5.2 of the belt 5 and the release belt 12 also hang downwards. They are regularly chosen to be significantly longer than the diameter of the ring body 1.

According to the FIG. 17 (*b*), when the belt free end 5.2 of the belt 5 is pulled (represented by the arrow with a solid border), the clamping force of the belt 5 in the clamp lock 11 is overcome, the belt length of the belt sling 5.1 being shortened, that is to say that the clamp lock 11 with the ring body 1 is pulled upwards (represented by the arrow with a dotted border).

The pulling down of the ring body 1 attached to the clamp lock 11 is illustrated in FIG. 17 (*c*): by pulling on the release belt 12 (represented by the arrow with a solid border), the self-locking of the belt 5 in the clamp lock 11 is released by unlocking the spring-loaded locking device, whereby the clamp lock 11 is now pulled down while the belt 5 slides through the clamp lock 11. The belt length of the belt sling 5.1 is thereby increased, that is, the clamp lock 11 with the ring body 1 is pulled downwards (represented by the arrow with a dotted border).

Figure 19:
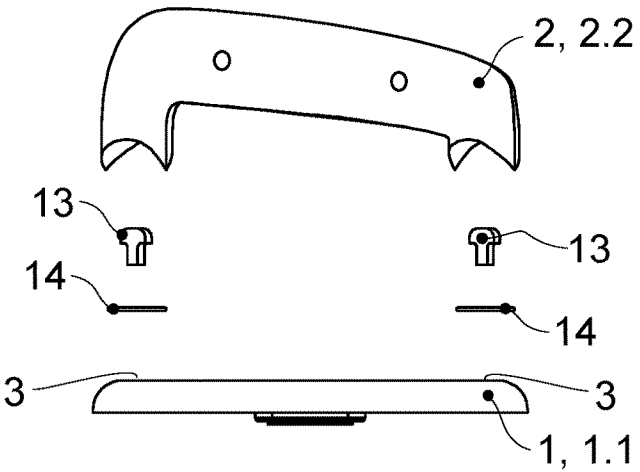
FIG. 19: a ring body half-shell according to the embodiment according to FIG. 18, disassembled into individual components, in a side view.
Figure 18:
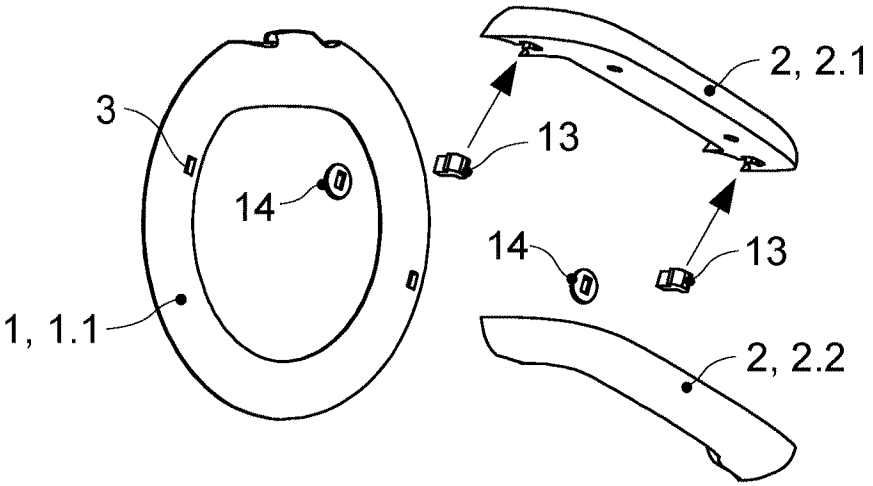
FIG. 18: a ring body half-shell with a quick-release bow handle, dismantled into individual components, in a perspective view.

FIG. 18 and FIG. 19 show the ring body half-shell 1.1 of the ring body 1, to which the bow handle 2, which can be assembled from the two bow handle half-shells 2.1, 2.2, can be attached in the area of the fastening location 3 by means of the quick connectors 13. In the area of the fastening locations 3, the pressure sensor 14 can also be integrated between the ring body 1 and the bow handle end of the bow handle 2 that is attached to the respective fastening location 3.

Figure 20:
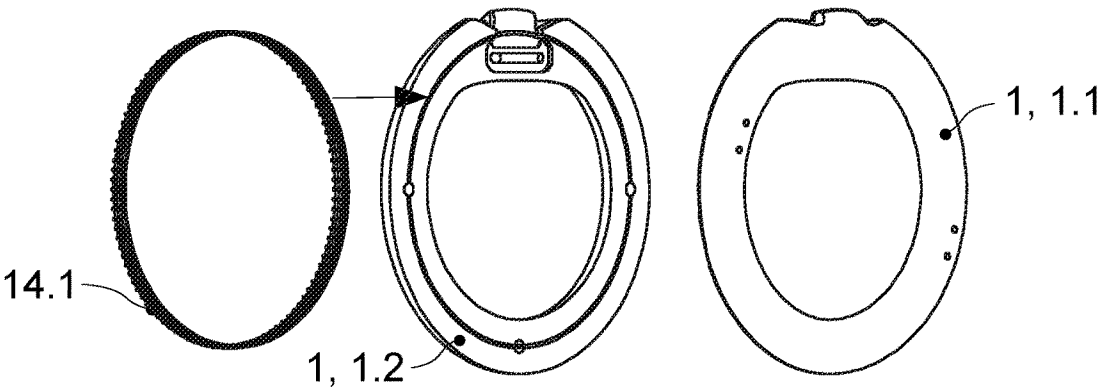
FIG. 20: a gymnastics ring with an integrated ring of pressure sensors, dismantled into individual components, in a perspective view.

The ring body 1 according to FIG. 20 has a ring of pressure sensors 14.1 with a plurality of pressure sensors, the ring of pressure sensors 14.1 being insertable between the ring body half-shells 1.1, 1.2 in such a way that the pressure sensors of the ring of pressure sensors 14.1 are arranged evenly along the circular line of the ring body rotation torus. The pressure sensors can be arranged inside the ring body 1. However, they preferably protrude slightly from the ring body surface-on the ring body half-shell 1.2—so that the pressure sensors directly touch this surface when the ring body 1 is placed on a flat surface, for example on the floor.

Figure 21:
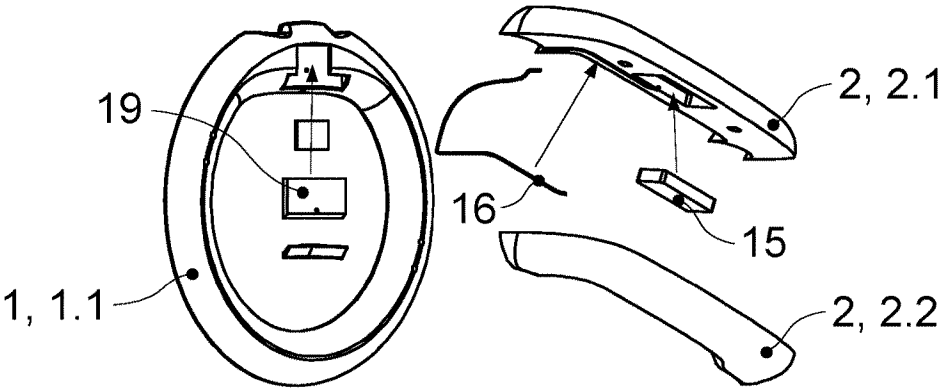
FIG. 21: a gymnastics ring with an integrated battery, dismantled into individual components, in perspective view.

The ring body half-shell 1.1 of the ring body 1 according to FIG. 21 has a recess for the display 19 which can be inserted into this recess. In addition, the battery 15, which is electrically connected via the cable 16, is integrated in the bow handle 2 between the two bow handle half-shells 2.1, 2.2.

Figure 23:
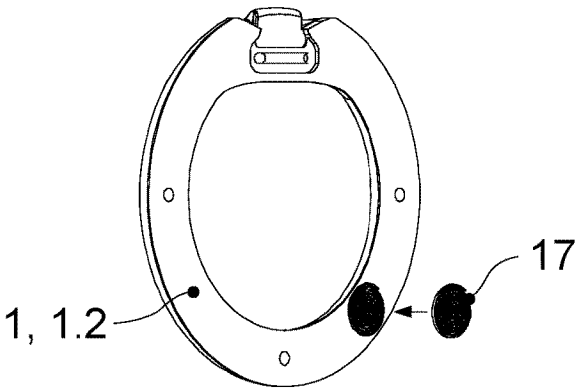
FIG. 23: a ring body half-shell with a circular disc-shaped charging coil, dismantled into individual components, in a perspective view.
Figure 22:
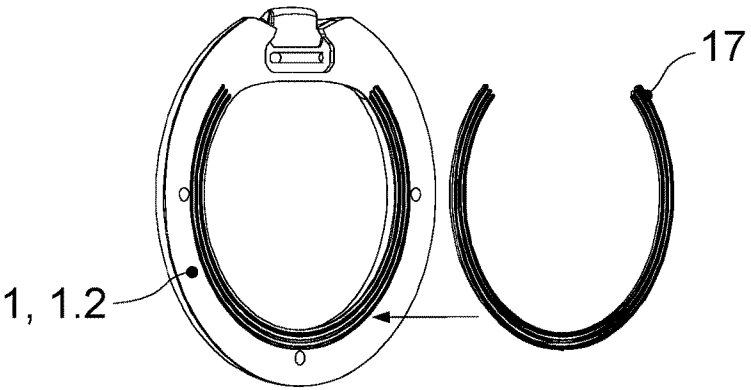
FIG. 22: a ring body half-shell with a circular arc-shaped charging coil, dismantled into individual components, in a perspective view.

FIG. 22 and FIG. 23 show two different designs of charging coils 17 that can be integrated into the ring body 1, each of which can be inserted into a recess in the ring body half-shell 1.2 that is geometrically adapted to the respective charging coil 17. The charging coil 17 according to FIG. 22 is designed to be inserted into the ring body half-shell 1.2 in the shape of a circular arc, following the shape of the ring body 1, for almost the entire circumference. The charging coil 17 according to FIG. 23, on the other hand, is intended for local positioning and is designed in the shape of a circular disk.

Figure 24:
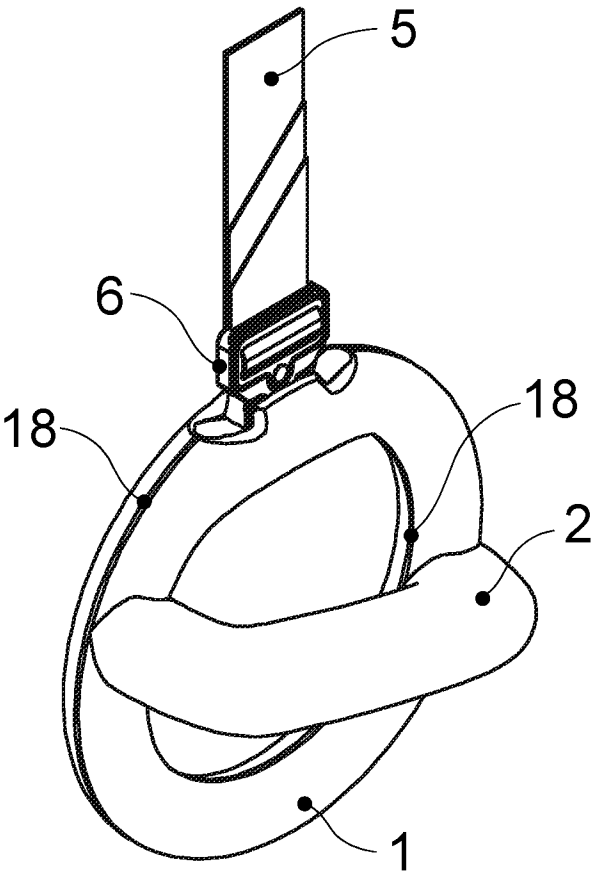
FIG. 24: a gymnastics ring with illuminants in perspective view.

In the gymnastics ring according to FIG. 24, the illuminants 18 are integrated into the ring body 1, on the one hand on the inner contour and on the other hand on the outer contour. The respective illuminant 18 is designed as a light tube, light guide or LED strip, which is inserted between the two ring body half-shells 1.1, 1.2 so that the light radiates circumferentially along the respective contour line of the ring body 1.

Figure 25:
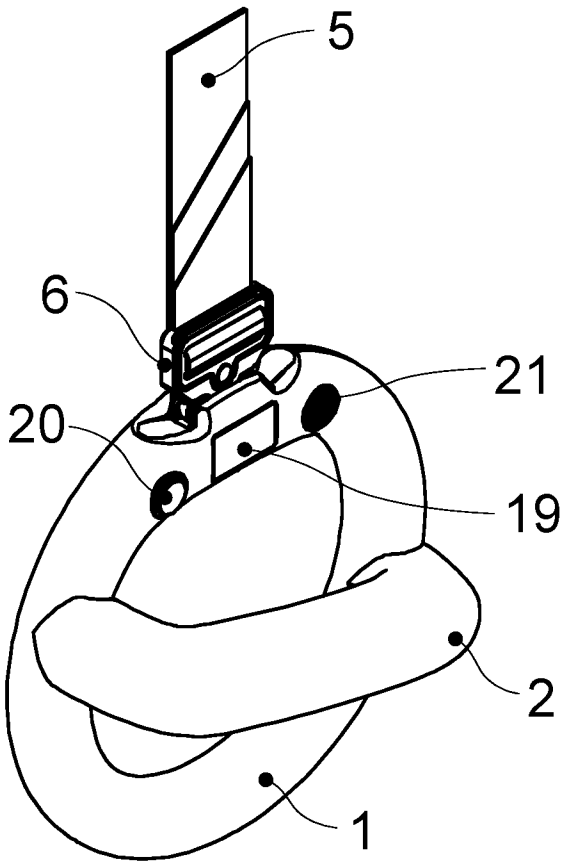
FIG. 25: a gymnastics ring with control elements in perspective view.

FIG. 25 shows further electronic components that can be integrated into the gymnastics ring, namely the display 19 as a display element, the push button 20 for operating and controlling integrated electronic components and the sweat—and weather-resistant speaker 21, via which training commands can be issued, for example.

Figure 26:
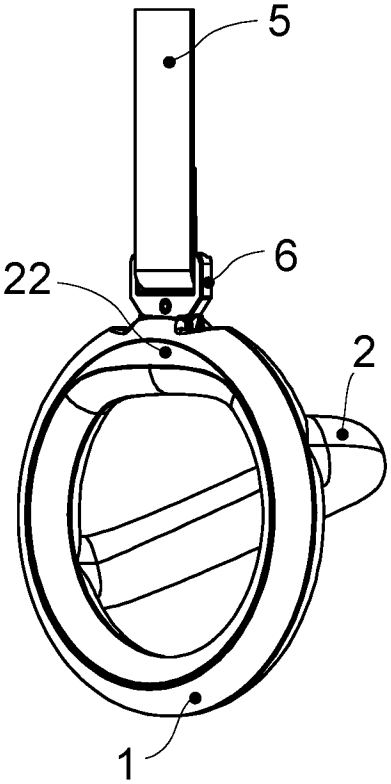
FIG. 26: a gymnastics ring with anti-slip insert in perspective view.

In the gymnastics ring according to FIG. 26, the anti-slip insert 22 made of elastomeric material, for example rubber or silicone rubber, is integrated. The anti-slip insert 22 improves the grip of the ring body 1. It is preferably designed to be interchangeable and/or customizable.

Figure 27:
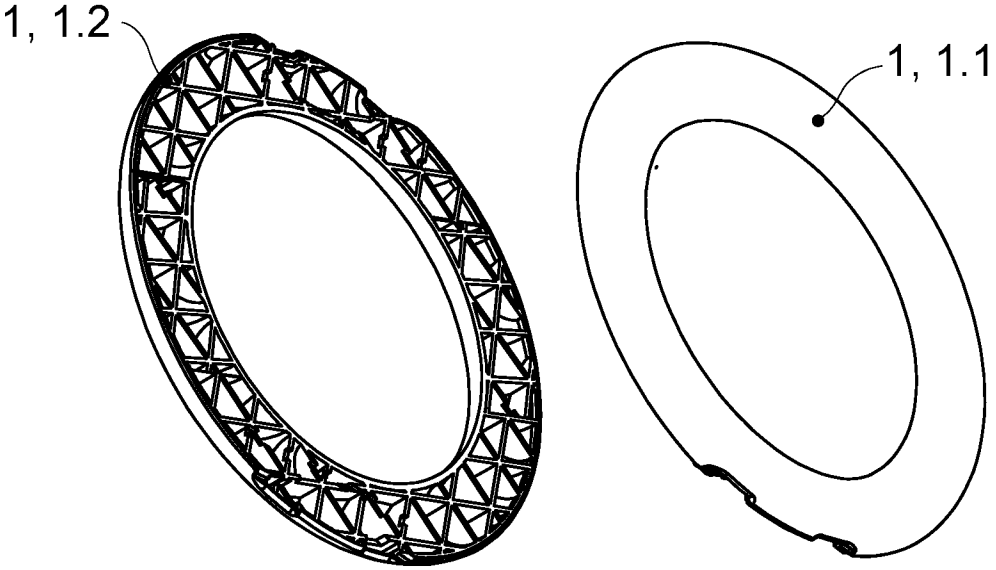
FIG. 27: ring body half-shells with hollow structure in perspective view.

The two ring body half-shells 1.1, 1.2 of the ring body 1 according to FIG. 27 have an inner hollow structure with truss-like stiffening elements.

Figure 28:
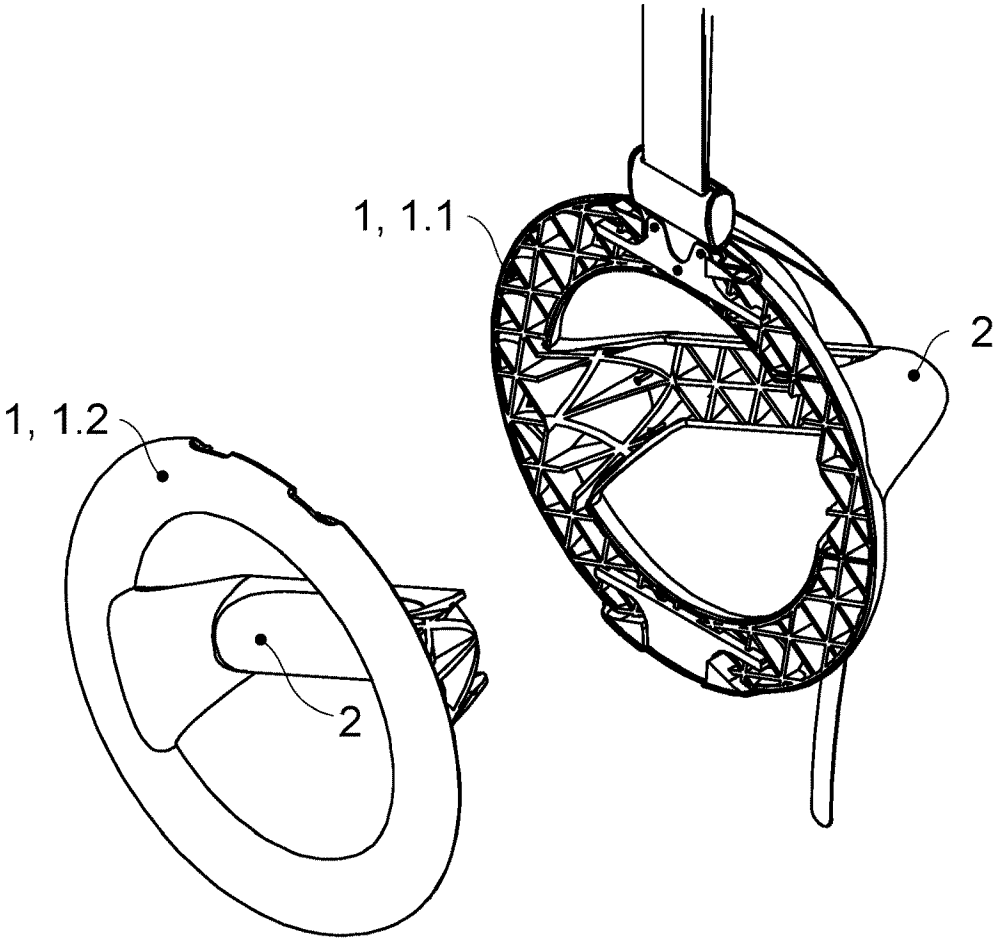
FIG. 28: ring body half-shells with integral bow handle parts in perspective view.

The gymnastics ring according to FIG. 28 has a comparable inner stiffening hollow structure. On each of the ring body half-shells 1.1, 1.2 of the ring body 1, a half-shell-shaped part of the bow handle 2 is formed or realized as an integral part. The separating plane of the bow handle 2 runs along the bow line.

Figure 29:
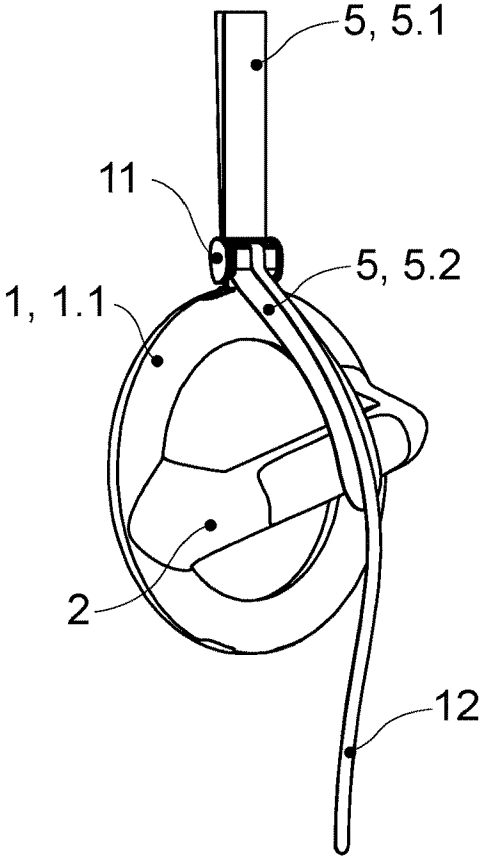
FIG. 29: the training system with a gymnastics ring with an integral bow handle in a perspective view.

The gymnastics ring according to the training shown in FIG. 28 is shown as part of the training system in FIG. 29. Moreover, the training system shown in FIG. 29 corresponds to that in FIGS. 16 and 17.

Figure 30:
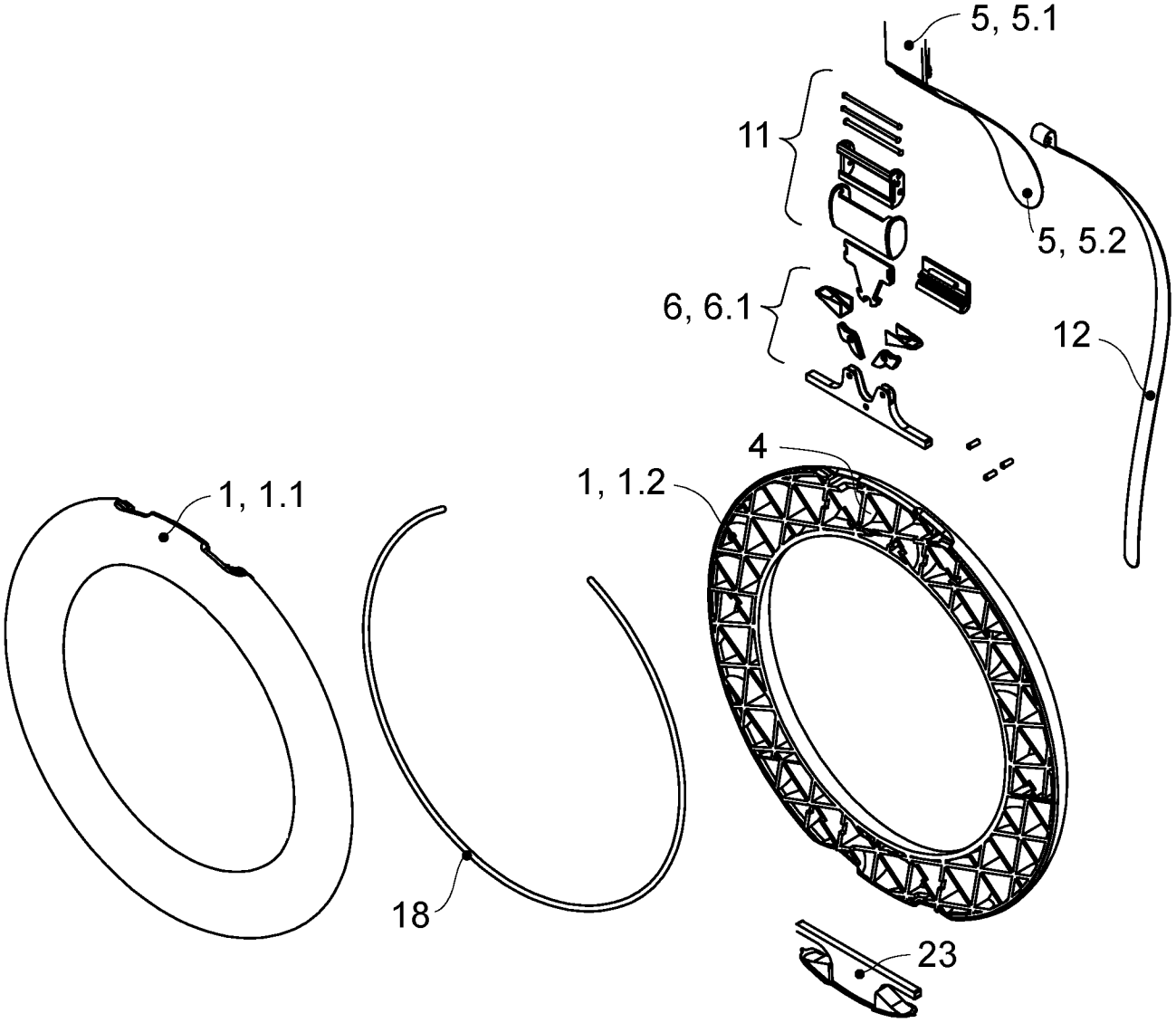
FIG. 30: various components of the training system.

In FIG. 30, various components of the training system are shown as individual components that have already been described in the previous figures. In addition, the inlay 23, a component made of elastomer or rubber, is shown, which serves both as a filling element for recesses in the ring body 1 and as an element that improves grip.

Figure 31:
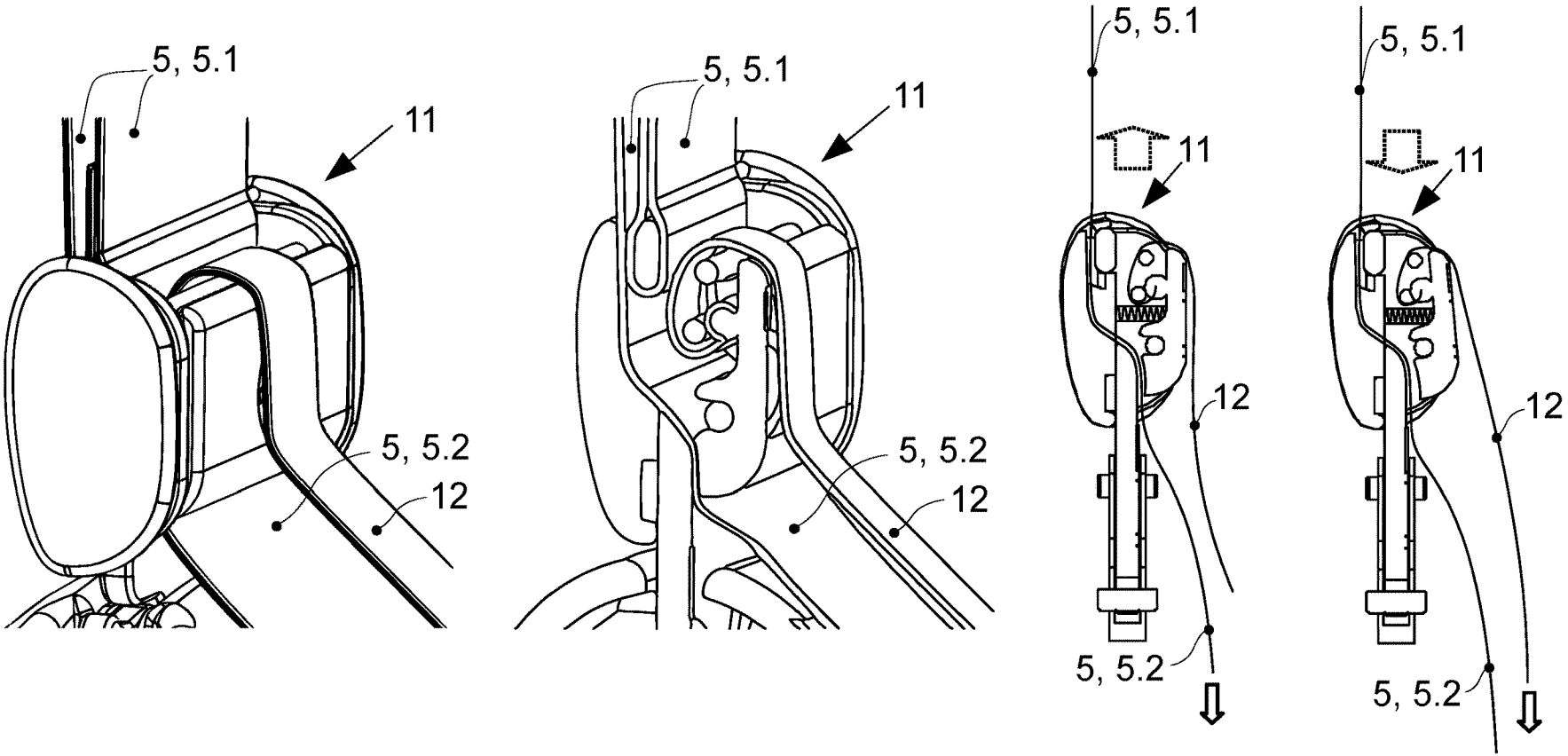
FIG. 31: an embodiment of the belt adjustment unit in various detailed views, und

In FIG. 31, the belt adjustment unit with the guidance of the belt 5 in the clamp lock 11 is shown in detail. FIG. 31 (*a*) is a closed perspective view and FIG. 31 (*b*) is a broken perspective view of the belt adjustment unit. The sectional views of FIG. 31 (*c*) and (*d*) show in FIG. 31 (*c*) the belt adjustment unit with a locked clamp lock 11 and in FIG. 31 (*d*) with an unlocked clamp lock 11. In the locked state according to FIG. 31 (*c*), the belt 5 can be pulled through the clamp lock 11 by pulling on the belt free end 5.2 (arrow with solid border), whereby the clamp lock 11 moves upwards in the load-bearing belt sling 5.1 (arrow with dotted border). According to FIG. 31 (*d*), by pulling on the release belt 12 (arrow with solid border), the self-locking in the clamp lock 11 is released, that means unlocked, whereby the clamp lock 11 is simultaneously pulled downwards along the belt 5 (arrow with dotted border).

Figure 32:
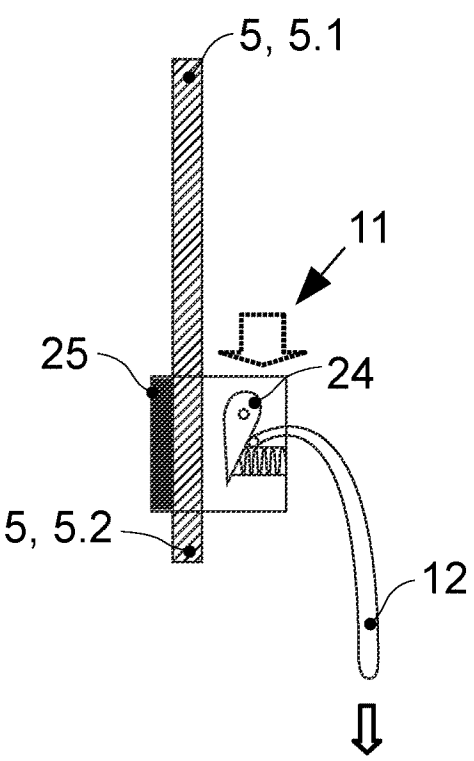
FIG. 32: an alternative version of the clamp lock of the belt adjustment unit.
Figure 32:
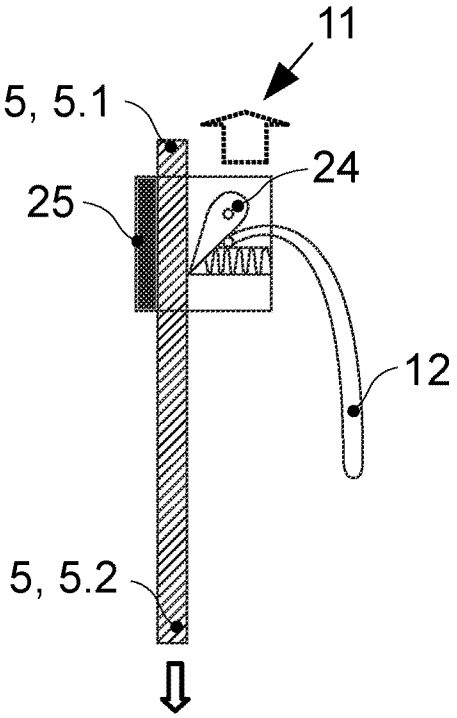
Figure 32:
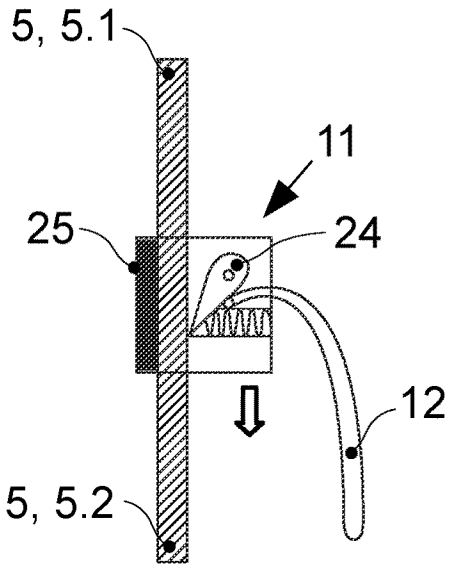

The embodiment of the belt adjustment unit according to FIG. 32 works according to a similar functional principle as the embodiment of the belt adjustment unit according to FIG. 31. The belt 5 is clamped in the clamp lock 11 between the compression spring-loaded locking element 24 and the friction element 25. When the clamp lock 11 is loaded by downward pulling (arrow with solid border), shown in FIG. 32 (*a*), self-locking occurs through the locking element 24 on the belt 5—similar to a pawl. The clamp lock 11 is fixed to the belt 5 in this position. By pulling on the belt free end 5.2—see FIG. 32 (*b*)—the belt 5 can be pulled through the clamp lock 11 after overcoming the clamping force exerted on the belt 5 between the locking element 24 and the friction element 25, whereby the clamp lock 11 now moves upwards along the belt sling 5.1. When the release belt 12 is pulled downwards-see FIG. 32 (*c*)—the locking element 24 is pulled away from the belt 5 by compression of the compression spring, that means, the clamp lock 11 is unlocked. The pull on the release belt 12 simultaneously leads to the clamp lock 11 being pulled down along the belt 5.

LIST OF REFERENCE NUMERALS

1 ring body
1.1, 1.2 ring body half-shell
2 bow handle
2.1, 2.2 bow handle half-shell
3 fastening location
4 belt holder pocket
5 belt
5.1 load-bearing belt sling
5.2 load-free belt free end
6 belt holder
6.1 belt lock
6.2 lock tongue
7 belt holder groove
8 reinforcement plate
9 pin
10 screw
11 clamp lock
12 release belt
13 quick connector
14 pressure sensor
14.1 ring of pressure sensors
15 battery
16 cable
17 charging coil
18 illuminant
19 display
20 push button
21 speaker
22 anti-slip insert
23 inlay
24 locking element
25 friction element

The invention claimed is:

1. A gymnastic ring comprising:

a ring body having the basic shape of a rotational torus produced by rotation of a base circle about an axis of rotation, the ring body defining an equatorial plane lying perpendicular to the axis of rotation of the ring body and passing through the center of the base circle, the ring body being divided into two separate ring body half-shells on the equatorial plane of the ring body;

at least one belt holder for holding a belt; and at least one belt holder pocket formed within the ring body and aligned in the equatorial plane for fastening the belt;

wherein the belt is configured to be fixed in or on the ring body using the belt holder which can be inserted into the belt holder pocket in a form-fitting manner between the two ring body half-shells.

2. The gymnastics ring according to claim 1, further comprising a bow handle attached to the ring body in a cantilevered manner at a distance from the equatorial plane of the ring body, the bow handle having a handle center piece located between two bow handle ends and being mirror-symmetrical with respect to a handle center plane that longitudinally intersects the bow handle, wherein the bow handle is aligned with the ring body in such that the handle center plane of the bow handle lies in an axial sectional plane of the ring body running through the axis of rotation of the ring body, and wherein at the two radially opposite intersection positions of the axial sectional plane of the ring body, at least one fastening location is provided on the ring body, on which one of the two ends of the bow handle is attached to the ring body such that both ends of the bow handle point towards the same side of the equatorial plane of the ring body.

3. The gymnastics ring according to claim 2, wherein the handle center piece of the bow handle is straight in its longitudinal extent and forms an angle of 7°±2° with the equatorial plane.

4. The gymnastics ring according to claim 2, wherein the handle center piece of the bow handle has a straight section in its longitudinal extent that is aligned parallel to the equatorial plane.

5. The gymnastics ring according to claim 2, wherein at least the handle center piece of the bow handle has an oval cross-sectional profile, wherein this oval cross-sectional profile has a greater curvature on the side of the bow handle facing the ring body than on the side of the bow handle facing away from the ring body.

6. The gymnastics ring according to claim 2, further comprising:

a pressure sensor inserted at least at one of the fastening locations between the ring body and the bow handle end attached to this fastening location, and a transmitting unit connected to the pressure sensor for wireless signal transmission of the signals detected by the pressure sensor.

7. The gymnastics ring according to claim 2, wherein the bow handle is releasably attached to the ring body by connecting elements hidden between the two ring body half-shells.

8. The gymnastics ring according to claim 1, further comprising a belt holder groove enclosed between the two ring body half-shells, said belt holder groove geometrically matching the belt holder for insertion of the belt holder in the form-fitting manner.

9. The gymnastics ring according to claim 8, wherein the belt holder is a two-part locking system with a belt lock and a lock tongue configured to be snapped into the belt lock.

10. The gymnastics ring according to claim 9, wherein a part of the lock tongue for fastening the belt is a belt buckle, a clamp buckle, or a clamp lock.

11. The gymnastics ring according to claim 1, wherein the ring body half-shells have an inner hollow structure with truss-like stiffening elements.

12. A training system with a hanging ring body, the system comprising:

a belt;

a gymnastics ring comprising:

a ring body having the basic shape of a rotational torus produced by rotation of a base circle about an axis of rotation, the ring body defining an equatorial plane lying perpendicular to the axis of rotation of the ring body and passing through the center of the base circle;

at least one belt holder for holding the belt; and at least one belt holder pocket formed within the ring body and aligned in the equatorial plane for fastening the belt;

wherein the belt is configured to be fixed in or on the ring body using the belt holder which can be inserted into the belt holder pocket in a form-fitting manner; and a belt adjustment unit comprising:

a clamp lock; and a release belt;

wherein the belt is guided through the clamp lock such that:

a load-bearing belt sling of the belt is formed;

the belt clamps itself in the clamp lock in a self-locking manner when a tensile load is applied to the belt sling;

the belt can be pulled through the clamp lock by pulling on a belt free end of the belt that is led out of the clamp lock to shorten the belt length in the load-bearing belt sling; and by pulling on the release belt attached to the clamp lock, the clamp lock can be moved along the belt to release the self-locking to lengthen the belt length in the load-bearing belt sling.

* * * * *